US012172799B2

(12) United States Patent
Isozaki

(10) Patent No.: US 12,172,799 B2
(45) Date of Patent: Dec. 24, 2024

(54) HOLDER

(71) Applicant: FUJIFILM Corporation, Tokyo (JP)

(72) Inventor: Makoto Isozaki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 95 days.

(21) Appl. No.: 17/870,836

(22) Filed: Jul. 22, 2022

(65) Prior Publication Data

US 2022/0355976 A1 Nov. 10, 2022

Related U.S. Application Data

(63) Continuation of application No. PCT/JP2021/003264, filed on Jan. 29, 2021.

(30) Foreign Application Priority Data

Jan. 31, 2020 (JP) ..... 2020-015432

(51) Int. Cl.
*A47G 23/02* (2006.01)
*B65D 23/06* (2006.01)
(Continued)

(52) U.S. Cl.
CPC ..... *B65D 23/0885* (2013.01); *B65D 23/06* (2013.01); *B65D 23/104* (2013.01)

(58) Field of Classification Search
CPC .... A47G 23/0241; A47G 23/02; B65D 23/08; B65D 23/0885
See application file for complete search history.

(56) References Cited

U.S. PATENT DOCUMENTS 1,733,571 A * 10/1929 Alden ..... B65D 23/08 229/4.5
3,910,328 A 10/1975 Marcoux
(Continued)

FOREIGN PATENT DOCUMENTS

CN 103391889 11/2013
CN 109094937 12/2018
(Continued)

OTHER PUBLICATIONS

Office Action of Japan Counterpart Application, with English translation thereof, issued on Jan. 4, 2023, pp. 1-6.
(Continued)

*Primary Examiner* — Stephen J Castellano
(74) *Attorney, Agent, or Firm* — JCIPRNET

(57) ABSTRACT

A holder for a bottle excellent in handleability is provided. A holder of the present invention is a holder for holding, in an internal space, a bottle having a body part larger than a neck part below the neck part. The holder includes a bottom part; a top part having an opening smaller than a sectional size of the body part; and a grip portion extending in a height direction of the holder between the bottom part and the top part. A state of the holder is switched between a first state and a second state. In the first state, a portion of the holder is detached and separated from another portion of the holder, and hence the internal space is opened. In the second state, the bottom part supports a bottom surface of the bottle in the internal space, the grip portion is positioned beside the bottle, and the neck part protrudes from the opening.

3 Claims, 23 Drawing Sheets

(51) Int. Cl.
*B65D 23/08* (2006.01)
*B65D 23/10* (2006.01)

(56) References Cited

U.S. PATENT DOCUMENTS

| | | | | |
|---|---|---|---|---|
| 5,704,484 | A | 1/1998 | Spinks et al. | |
| 5,921,431 | A * | 7/1999 | Pych | A47G 23/0241 215/393 |
| 6,913,159 | B1 | 7/2005 | Goldberg | |
| 9,469,439 | B1 * | 10/2016 | Polsinelli | B65D 23/106 |
| 2003/0183640 | A1 | 10/2003 | Bissell | |
| 2004/0135049 | A1 | 7/2004 | Kent-Fawkes | |
| 2008/0190948 | A1 * | 8/2008 | Sayasithsena | B65D 25/24 220/759 |
| 2009/0065469 | A1 | 3/2009 | McClellan et al. | |
| 2012/0006712 | A1 | 1/2012 | Kaplan et al. | |
| 2014/0042120 | A1 | 2/2014 | Kataoka et al. | |

FOREIGN PATENT DOCUMENTS

| | | |
|---|---|---|
| DE | 8103636 | 5/1981 |
| DE | 4027813 | 3/1992 |
| DE | 9413988 | 12/1994 |
| GB | 1349318 | 4/1974 |
| JP | S4816771 | 3/1973 |
| WO | 0183321 | 11/2001 |

OTHER PUBLICATIONS

"Office Action of China Counterpart Application", issued on Dec. 5, 2023, with English translation thereof, pp. 1-15.
"International Search Report (Form PCT/ISA/210) of PCT/JP2021/003264," mailed on Mar. 16, 2021, with English translation thereof, pp. 1-5.
"Written Opinion of The International Searching Authority (Form PCT/ISA/237)" of PCT/JP2021/003264, mailed on Mar. 16, 2021, with English translation thereof, pp. 1-8.
"Decision of Refusal of Japan Counterpart Application", issued on Jun. 20, 2023, with English translation thereof, p. 1-p. 3.

* cited by examiner

HOLDER

CROSS-REFERENCE TO RELATED APPLICATIONS

This application is a Continuation of PCT International Application No. PCT/JP2021/003264 filed on Jan. 29, 2021, which claims priority under 35 U.S.C. § 119(a) to Japanese Patent Application No. 2020-015432 filed on Jan. 31, 2020. The above application is hereby expressly incorporated by reference, in its entirety, into the present application.

BACKGROUND OF THE INVENTION

1. Field of the Invention

The present invention relates to a holder for holding a bottle.

2. Description of the Related Art

Conventionally, a bottle holder that houses and holds therein a bottle having a neck part and a body part larger than the neck part below the neck part has been used.

For example, a bottle case described in JP1973-16771A (JP-548-16771A) includes a bottom, four sides provided with handholes, and four web members. In this bottle case, each of the four web members is integrally formed with adjacent sides and extends obliquely with respect to planes of the sides with which the web member is integrally formed. Each of the web members extends over the full height of the case and has an abutment member near an opening end on an inner surface of the side.

SUMMARY OF THE INVENTION

However, the bottle case described in JP1973-16771A (JP-S48-16771A) is mainly used for carriage and stock, and for example, it is generally difficult to use the bottle housed in the case in the state without a change (specifically, to take out the liquid in the bottle housed in the case).

When the case in a state in which the bottle is housed in the case is carried, it is required that the case is more easily held. When the bottle housed in the case is stored, it is desirable to be able to store the bottle more safely. Further, when the bottle is housed in the case, it is required that the bottle is more easily put in the case.

As described above, a holder such as a case that houses a bottle therein is required to have excellent handleability.

The present invention has been made in view of the above-described circumstances, and an object thereof is to provide a holder for a bottle excellent in handleability.

To attain the above-described object, a holder of the present invention is a holder for holding, in an internal space, a bottle having a body part larger than a neck part below the neck part. The holder includes a bottom part; a top part having an opening smaller than a sectional size of the body part; and a grip portion extending in a height direction of the holder between the bottom part and the top part. A state of the holder is switched between a first state and a second state. In the first state, a portion of the holder is detached and separated from another portion of the holder, and hence the internal space is opened. In the second state, the bottom part supports a bottom surface of the bottle in the internal space, the grip portion is positioned beside the bottle, and the neck part protrudes from the opening.

Here, preferably, the top part is detachable from a main body part having the bottom part and the grip portion.

Moreover, preferably, the main body part has a first engagement portion, and the top part has a second engagement portion that engages with the first engagement portion.

Moreover, preferably, one of the first engagement portion and the second engagement portion is a recessed portion, and the other is a protruding portion.

Moreover, preferably, the first engagement portion and the second engagement portion engage with each other by rotating the top part with respect to the main body part in a state in which the protruding portion is inserted into the recessed portion.

Moreover, preferably, the holder consists of a plurality of holder components; each of the plurality of holder components has a portion of the bottom part, a portion of the top part, and a portion of the grip portion; in the first state, among the plurality of holder components, one component is detached from another component, and hence the bottom part, the top part, and the grip portion are divided; and in the second state, the one component is attached to the other component, and hence the bottom part, the top part, and the grip portion are assembled.

Moreover, preferably, the holder includes an extension part including the grip portion; and a joint portion that joins one end of the extension part and an outer edge of the bottom part. Preferably, the extension part is rotated with the joint portion as a starting point, and hence is erected with respect to the bottom part.

Moreover, preferably, the holder includes a pillar part erected on the bottom part. Preferably, the grip portion is provided at the pillar part.

Moreover, preferably, the grip portion has a cutout portion formed by cutting out a portion of the pillar part facing the internal space side.

Moreover, preferably, the holder includes a plurality of the pillar parts disposed at positions separated from each other, and the holder further has a connecting portion that connects the pillar parts at a position different from the bottom part.

Moreover, preferably, an outer side surface of the top part is inclined with respect to the height direction so as to be separated from a center of the top part toward a lower side.

Moreover, preferably, the bottom part has a liquid absorbing portion.

According to the present invention, a holder for a bottle excellent in handleability can be provided.

DESCRIPTION OF THE PREFERRED EMBODIMENTS

A holder according to an embodiment of the present invention will be described in detail below with reference to preferred embodiments illustrated in the accompanying drawings.

Holder

A holder of the present invention is a holder for holding, in an internal space, a bottle having a body part larger than a neck part below the neck part, and is excellent in handleability. Describing more specifically, the holder of the present invention includes a bottom part; a top part having an opening smaller than a sectional size of the body part; and a grip portion extending in a height direction of the holder between the bottom part and the top part. Also, a state of the holder is switched between a first state and a second state. In the first state, a portion of the holder is detached and separated from another portion of the holder, and hence the internal space is opened. In the second state, the bottom part supports a bottom surface of the bottle in the internal space, the grip portion is positioned beside the bottle, and the neck part protrudes from the opening.

Since the holder of the present invention configured as described above includes the grip portion extending in the height direction of the holder, the holder can be easily held by the grip portion being gripped. Also, the holder of the present invention, for example, can be easily carried in the state in which the bottle is held therein, and can be easily lifted to a relatively high position such as a shelf base or the like compared to a case where the bottle alone is lifted.

Moreover, the holder of the present invention can restrain the body part of the bottle by the top part in the state in which the bottle is held therein (that is, the second state). Further, in the second state, the neck part of the bottle protrudes from the opening of the top part. Accordingly, the liquid or the like in the bottle can be easily taken out by tilting the holder in the state in which the bottle is held.

Moreover, in the second state, the holder of the present invention supports the bottom surface of the bottle by the bottom part, and protects the body part of the bottle from above and from the side by the top part and the grip portion. Accordingly, the bottle can be stored more safely in the internal space of the holder. Thus, when the bottle is stored, carried or transported, packaging materials other than the holder can be omitted. Further, the bottle can be stocked (stored) more safely because the bottle can be prevented from toppling over and breaking.

Furthermore, state of the holder of the present invention can be freely switched between the first state and the second state. Thus, when the state of the holder is set to the first state and the internal space of the holder is opened, the bottle can be easily taken in and out.

First Embodiment

Hereinafter, a first embodiment of the present invention will be described with reference to the drawings.

Figure 1:
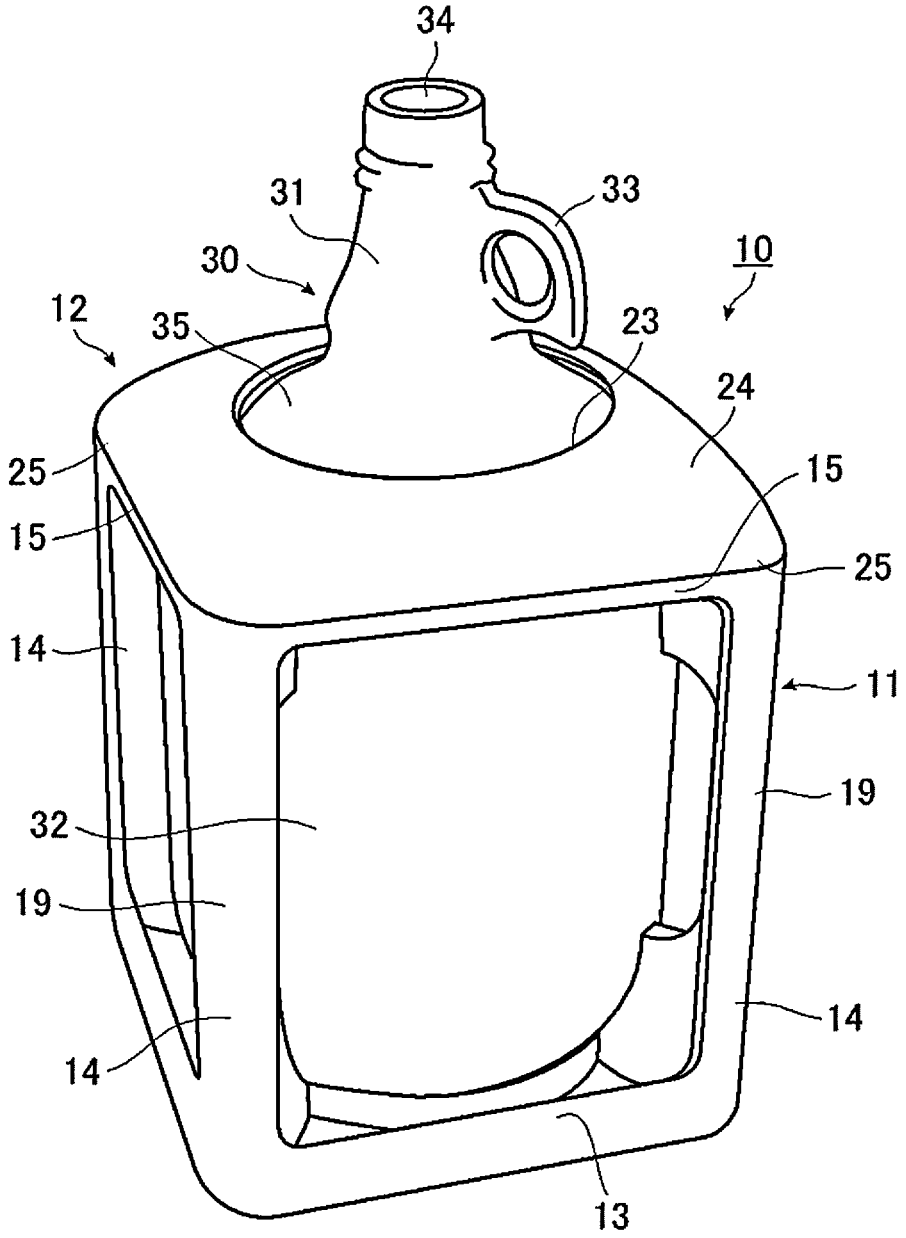
FIG. 1 is a perspective view illustrating a state in which a holder according to a first embodiment of the present invention is attached to a bottle and used.
Figure 2:
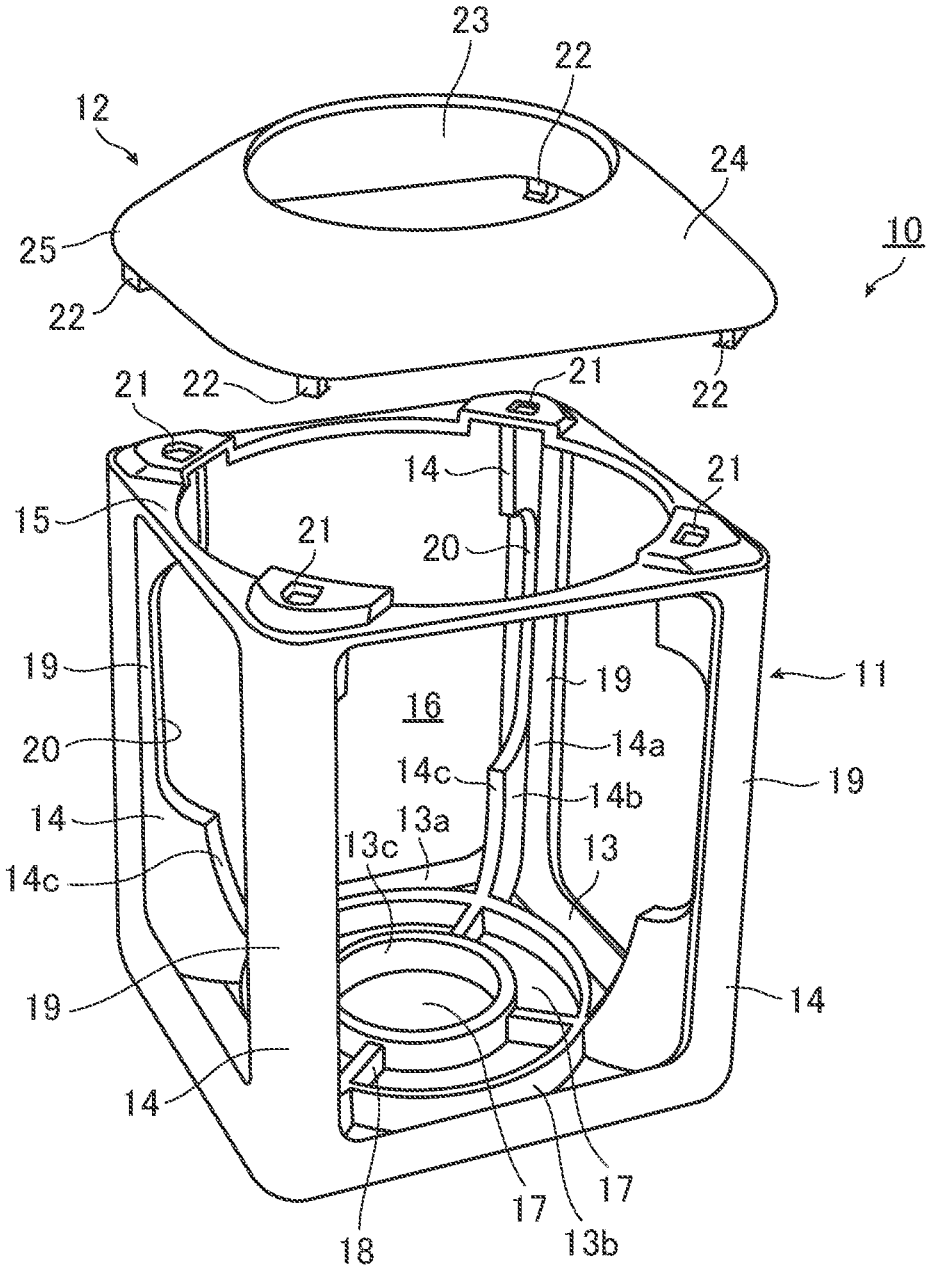
FIG. 2 is a perspective view illustrating a first state of the holder according to the first embodiment of the present invention.
Figure 3:
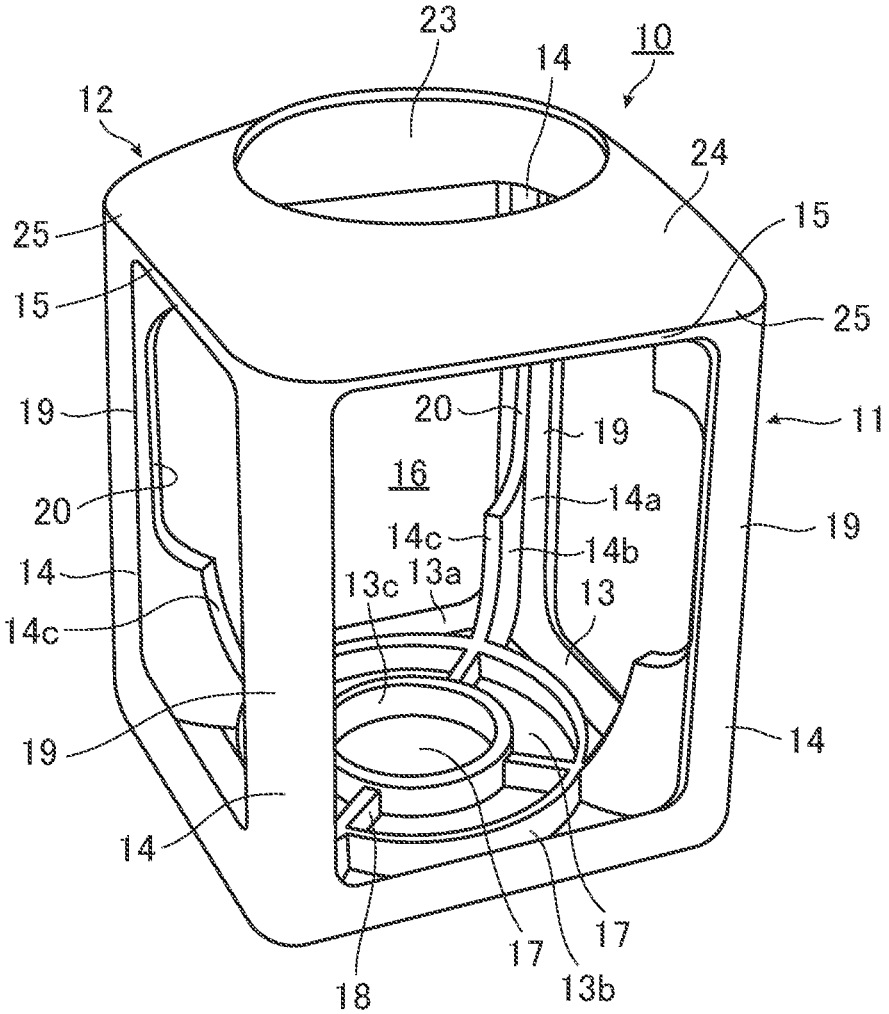
FIG. 3 is a perspective view illustrating a second state of the holder according to the first embodiment of the present invention.
Figure 4:
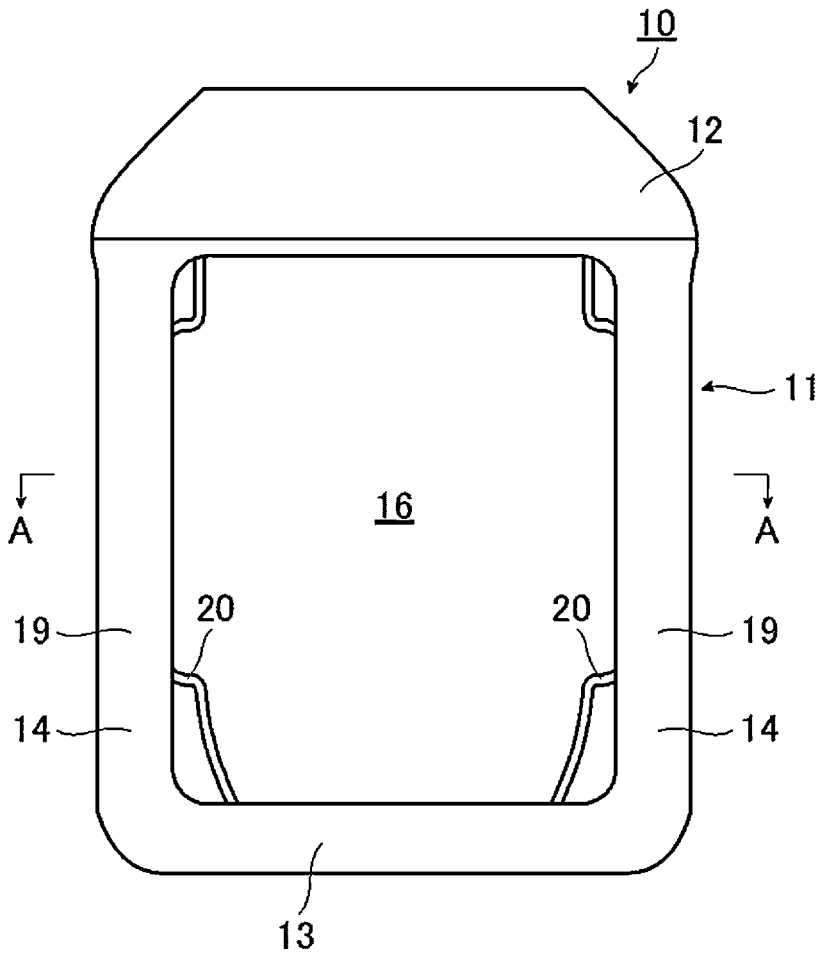
FIG. 4 is a front view illustrating the second state of the holder according to the first embodiment of the present invention.
Figure 5:
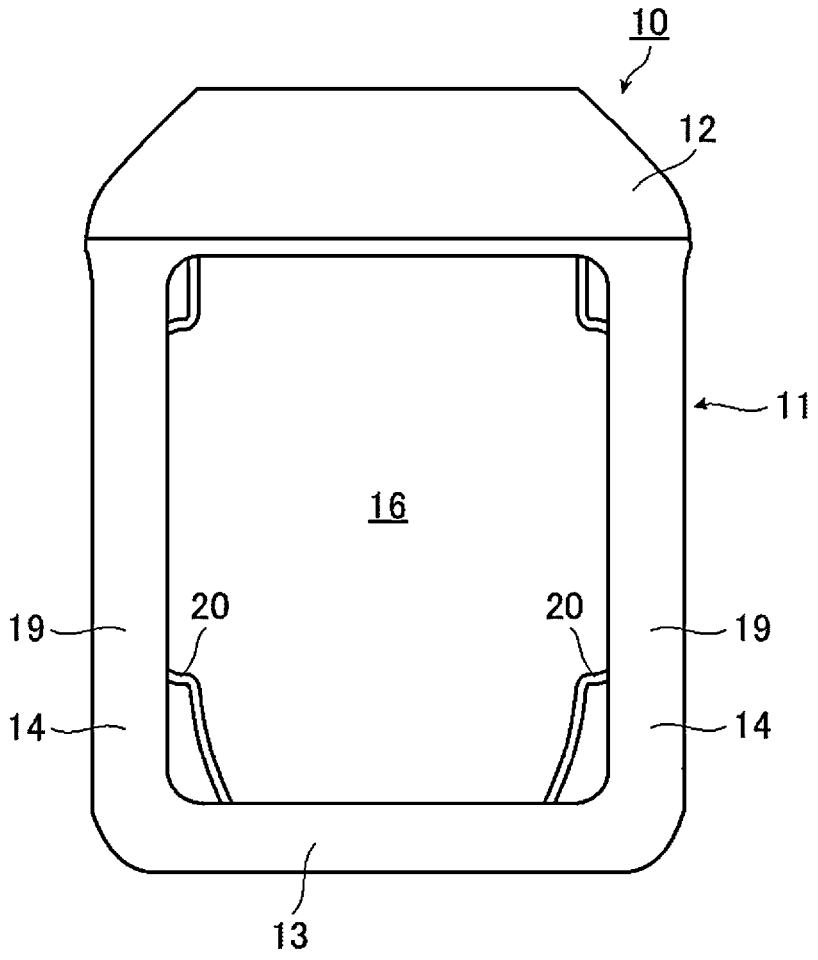
FIG. 5 is a left side view illustrating the second state of the holder according to the first embodiment of the present invention.
Figure 6:
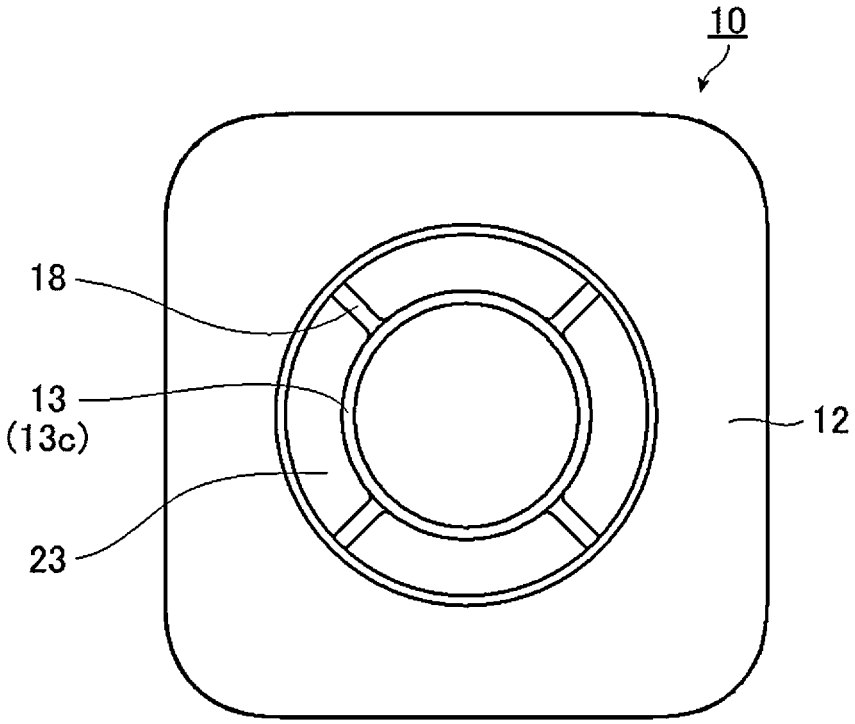
FIG. 6 is a plan view illustrating the second state of the holder according to the first embodiment of the present invention.
Figure 7:
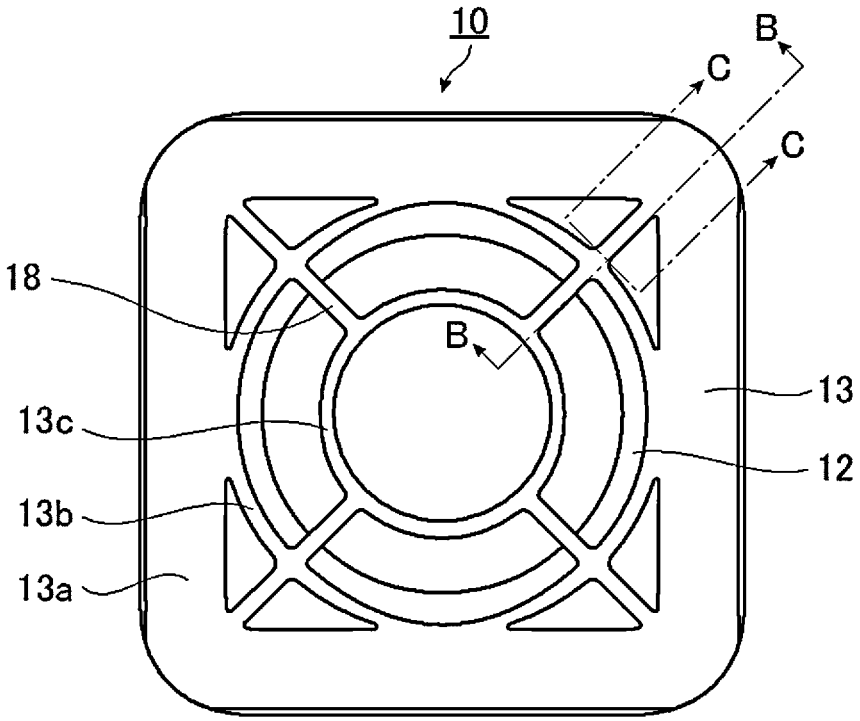
FIG. 7 is a bottom view illustrating the second state of the holder according to the first embodiment of the present invention.
Figure 8:
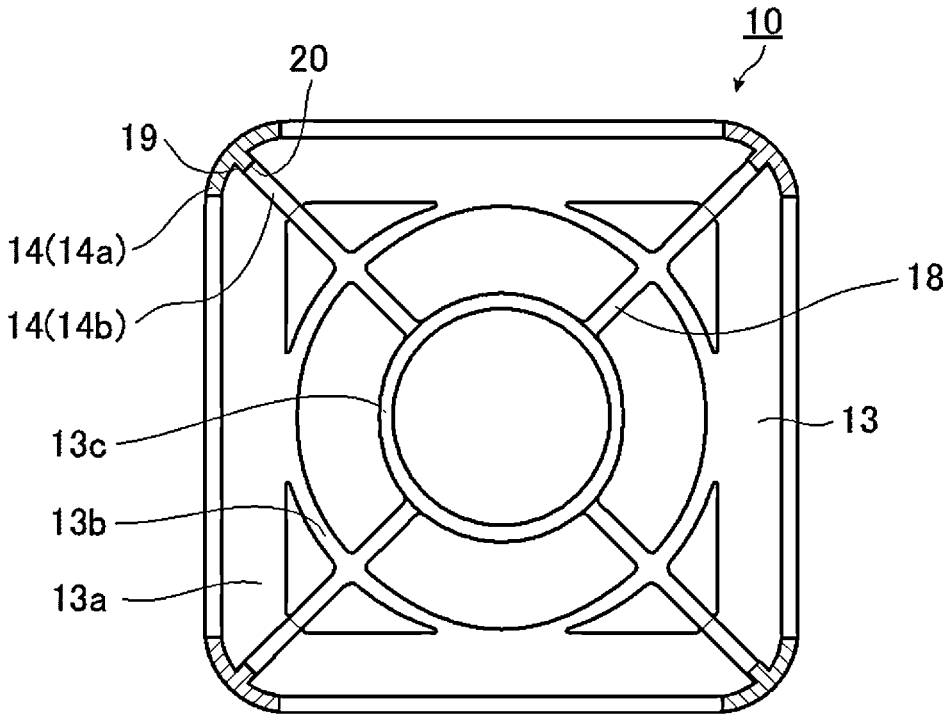
FIG. 8 is a sectional view taken along line A-A illustrating the second state of the holder according to the first embodiment of the present invention.
Figure 9:
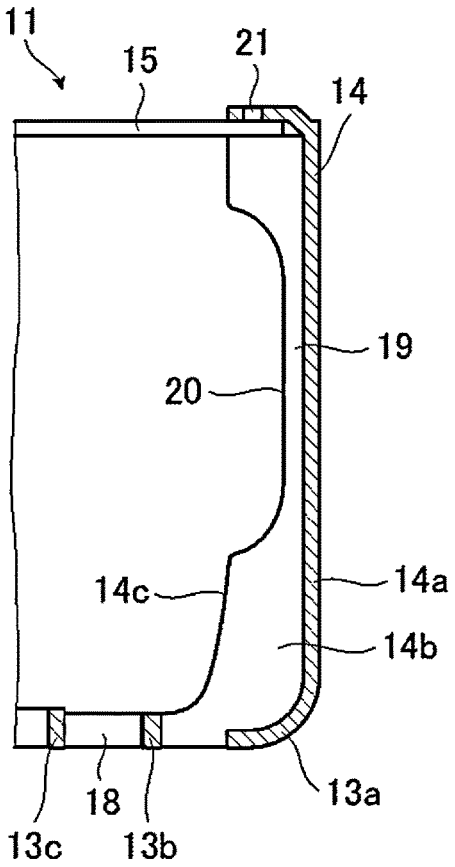
FIG. 9 is a sectional view taken along line B-B of a main body part according to the first embodiment of the present invention.
Figure 10:
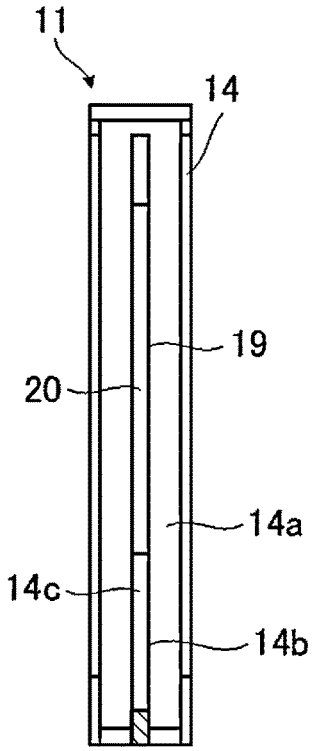
FIG. 10 is a sectional view taken along line C-C of the main body part according to the first embodiment of the present invention.

FIG. 1 is a perspective view illustrating a state in which a holder (hereinafter referred to as a holder 10) according to the first embodiment of the present invention is attached to a bottle 30 and used. FIG. 2 is a perspective view illustrating a first state of the holder 10. FIG. 3 is a perspective view illustrating a second state of the holder 10. FIG. 4 is a front view illustrating the second state of the holder 10. FIG. 5 is a left side view illustrating the second state of the holder 10. FIG. 6 is a plan view illustrating the second state of the holder 10. FIG. 7 is a bottom view illustrating the second state of the holder 10. FIG. 8 is a sectional view of the holder 10 taken along line A-A. FIG. 9 is a sectional view of a main body part 11 taken along line B-B. FIG. 10 is a sectional view of the main body part 11 taken along line C-C.

Note that, the rear view illustrating the second state of the holder 10 is symmetrical to the front view of FIG. 4. Also, the right side view illustrating the second state of the holder 10 is symmetrical to the left side view of FIG. 5.

Before describing the holder 10, the bottle 30 to be held by the holder 10 will be described.

The bottle 30 is a container whose inside can be filled with a liquid, and as illustrated in FIG. 1, has a neck part 31 and a body part 32 larger than the neck part 31 below the neck part 31.

Note that, as the bottle 30 to be held by the holder 10, a well-known gallon bottle having a capacity of 1 L to 5 L will be described as a specific example. However, the bottle to be held by the holder of the present invention is not limited to the gallon bottle. The holder of the present invention can be widely applied to a bottle having a body part larger than a neck part below the neck part, and can be used, for example, when such a bottle is stored, carried, or transported, or when a liquid in the bottle is taken out.

The bottle 30 that is a gallon bottle usually has a handle 33 provided at the neck part 31, and an opening portion 34 is provided at a distal end of the neck part 31. Further, like a general gallon bottle, at a shoulder part 35 defining an upper end portion of the body part 32, the diameter of the body part 32 is gradually increased downward from a base of the neck part 31, and a gradient is formed on an outer peripheral surface of the body part 32.

Note that, in the present embodiment, the bottle 30 in which the handle 33 is provided on the neck part 31 is exemplified. However, even a bottle (not illustrated) not including the handle 33 can be applied as the bottle 30 to be held by the holder 10.

The holder 10 is equipment (case) for holding the bottle 30 in its internal space 16, and as illustrated in FIGS. 1 to 7, has a main body part 11 and a top part 12 that is detachably fixed to an upper portion of the main body part 11.

Note that, the main body part 11 and the top part 12 are manufactured using a fiber material such as wood, metal, or paper, or a resin material, and are manufactured by injection molding of a synthetic resin in the present embodiment. The type of synthetic resin used as the material is not particularly limited; however, polyethylene, vinyl chloride resin, acrylic resin, ABS (Acrylonitrile butadiene styrene) resin, phenol resin, fluororesin, polycarbonate, polypropylene, or the like is suitable.

Configuration of Main Body Part

As illustrated in FIGS. 1 to 10, the main body part 11 has a bottom part 13, a pillar part 14, and a connecting portion 15. Also, a region surrounded by the bottom part 13, the pillar part 14, and the connecting portion 15 defines the internal space 16 of the holder 10 (that is, a storage space of the bottle 30).

The bottom part 13 is a member positioned at a lower portion of the holder 10, and supports a bottom surface of the bottle 30 when the bottle 30 is held in the internal space 16 (that is, when the state of the holder 10 is the second state). As illustrated in FIG. 3, the bottom part 13 of the present embodiment has a square outer portion 13*a* whose central portion is punched out to form a circular hole having a relatively large diameter, an annular first inner portion 13*b* disposed at a portion where the outer portion 13*a* is punched out, and a second inner portion 13*c* disposed inside the first inner portion 13*b* and having a diameter smaller than that of the first inner portion 13*b*. Holes 17 are provided between the outer portion 13*a* and the first inner portion 13*b*, between the first inner portion 13*b* and the second inner portion 13*c*, and inside the second inner portion 13*c* to communicate the internal space 16 with the outside of the holder 10. Also, a plurality of ribs 18 radially extending from an outer peripheral surface of the second inner portion 13*c* to an inner peripheral surface of the first inner portion 13*b* are provided at a constant pitch (for example, at intervals of about 90 degrees).

Note that, the shape of the bottom part 13 is not limited to the above-described shape, and may be, for example, a simple flat plate shape as long as the bottom part 13 can suitably support the bottom surface of the bottle 30.

The pillar part 14 is a portion erected with respect to the bottom part 13 and extending in a height direction of the holder 10. In the present embodiment, a plurality of the pillar parts 14 are provided at positions separated from each other, and specifically, as illustrated in FIG. 2, one pillar part 14 is disposed at each of four corners of the bottom part 13. Each pillar part 14 has a corner portion 14*a* positioned at an outer end of the holder 10 and constituting a corner section (corner) of the holder 10, and a rib-shaped portion 14*b* protruding in a rib shape from an inner surface of the corner portion 14*a*.

When the bottle 30 is held in the internal space 16 of the bottle 30 (that is, when the state of the holder 10 is the second state), each of the pillar parts 14 is positioned beside the body part 32 of the bottle 30 as illustrated in FIG. 1.

Note that, the height of the pillar parts 14 is set in accordance with the shape and size of the bottle 30 to be held, and all the pillar parts 14 may have the same height as in the present embodiment or may have different heights. Also, in the present embodiment, the pillar parts 14 are erected at the four corners of the bottom part 13, respectively, and the four pillar parts 14 are provided in total; however, the positions and the number of the pillar parts 14 are not limited to the above-described configuration.

A portion of each pillar part 14 facing the internal space 16 side, specifically, a tip portion (hereinafter, referred to as an inner end portion 14*c*) of the above-described rib-shaped portion 14*b* comes into contact with the outer peripheral surface of the body part 32 of the bottle 30 when the bottle 30 is held in the internal space 16 (that is, when the state of the holder 10 is the second state). Also, at a position below the rib-shaped portion 14*b*, a portion of the inner end portion 14*c* is connected to an outer peripheral surface of the first inner portion 13*b*.

Note that, a gap of about several millimeters is desirably provided between the inner end portion 14*c* and the bottle 30 in consideration of a size error or the like generated at the time of manufacturing the bottle 30.

Moreover, as illustrated in FIGS. 1 to 5, and 8 to 10, a grip portion 19 extending in the height direction of the holder 10 is provided at an intermediate position of each pillar part 14. The grip portion 19 has a cutout portion 20 formed by cutting out a substantially intermediate portion of the inner end portion 14*c* in a substantially quadrangular shape. When an operator (user) of the holder 10 holds the holder 10, the operator grips the grip portion 19 composed of the cutout portion 20 with a hand. At this time, since the cutout portion 20 having the substantially quadrangular shape is provided, the user can properly grip the grip portion 19.

Note that, in the present embodiment, the grip portions 19 (that is, the cutout portions 20) are formed in all of the four pillar parts 14; however, the pillar parts 14 having the grip portions 19 need not be all of the pillar parts 14, and may be only some (that is, one to three) of the pillar parts 14.

Also, the shapes of the pillar parts 14 and the grip portions 19 are not particularly limited. For example, the grip portions 19 each may be provided by forming a long hole into which the fingers of the user can be inserted, instead of the cutout portion 20.

Alternatively, the pillar parts 14 each may be a circular columnar rod body, and in this case, each portion of the pillar part 14 can be the grip portion 19. In this case, it is desirable that a portion or the whole of the pillar part 14 is subjected to processing (for example, surface processing for fitting with the fingers of the user and facilitating gripping) so as to be easily gripped by the user.

As illustrated in FIGS. 1 to 3, the connecting portion 15 is a linear component positioned at an upper end of the main body part 11, and connects the pillar parts 14 erected at mutually separated positions to each other. In the present embodiment, the connecting portion 15 connects upper end portions of two adjacent pillar parts 14 among the pillar parts 14 disposed at the four corners of the bottom part 13, and is disposed in a frame shape so as to surround the internal space 16.

Note that, in the present embodiment, the connecting portion 15 connects the pillar parts 14 to each other at the upper end portions of the pillar parts 14; however, the connecting portion 15 may connect the pillar parts 14 to each other at any portion of the pillar parts 14.

The connecting portion 15 is positioned at the upper end of the main body part 11, and the top part 12 is attached above the connecting portion 15 so as to cover the connecting portion 15. Thus, a first engagement portion 21 consisting of a recessed portion formed for attaching the top part 12 is provided at a portion of an upper surface of the connecting portion 15 that comes into contact with the top part 12. The recessed portion that is the first engagement portion 21 has a shape that engages with a second engagement portion 22 provided on the top part 12 side. In particular, in the present embodiment, the first engagement portion 21 is provided at a position directly above the pillar part 14 in each of the four pillar parts 14.

Configuration of Top Part

The top part 12 is a member detachably attached to an upper end portion of the main body part 11, and serves as a lid covering an upper end opening of the main body part 11 as illustrated in FIG. 1. The top part 12 of the present embodiment is composed of a hollow body having a substantially truncated pyramidal outer-diameter shape.

Note that, the outer-diameter shape of the top part 12 is not limited to a truncated pyramidal shape, and may be a truncated conical shape or a substantially domed shape.

Openings are provided at an upper end and a lower end of the top part 12, respectively, and both openings communicate with each other. As illustrated in FIG. 2, an opening 23 provided at an upper end of the top part 12 is a circular opening formed substantially at the center of the top part 12, and communicates the internal space 16 with the outside of the holder 10 in a state in which the top part 12 is attached to the main body part 11. The size of the opening 23 is a size smaller than the size (outer diameter) of the body part 32 of the bottle 30, larger than the size (outer diameter) of the neck part 31 of the bottle 30, and not interfering with the handle 33. Since the above-described opening 23 is provided in the top part 12, the neck part 31 of the bottle 30 is allowed to protrude to the outside of the top part 12 (to the outside of the holder 10), and the bottle 30 can be restricted from coming off from the holder 10 by the top part 12.

Each of four outer side surfaces 24 of the top part 12 is inclined with respect to the height direction of the holder 10 so as to be separated from the center of the top part 12 toward a lower side, that is, in a direction in which the outer side surface 24 is lowered from the opening 23 of the top part 12 toward an outer edge 25 of the top part 12.

Note that, the degree of inclination of the outer side surface 24 of the top part 12 is preferably a degree of inclination corresponding to the gradient of the shoulder part 35 of the bottle 30, and is more preferably set such that the top part 12 fits with the shoulder part 35.

Moreover, the second engagement portion 22, which is a protruding portion for attaching the top part 12 to the main body part 11, is provided at a portion of a back surface of the top part 12 that comes into contact with the upper end of the main body part 11. The second engagement portion 22 has a shape that engages with each of the first engagement portions 21 provided at the main body part 11, and, as illustrated in FIG. 2, is disposed at each of positions corresponding to the first engagement portions 21. The second engagement portions 22 are provided at four positions in total.

An engagement method by the first engagement portion 21 and the second engagement portion 22 will be described.

Figure 11A:
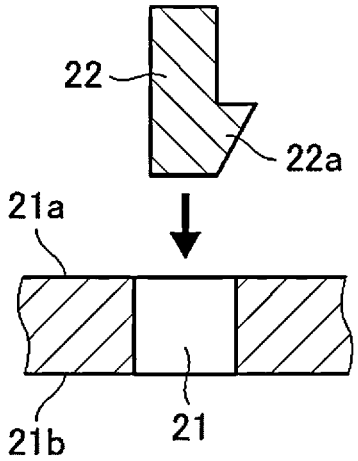
FIG. 11A is an explanatory view illustrating an example of a first engagement portion and a second engagement portion.
Figure 11B:
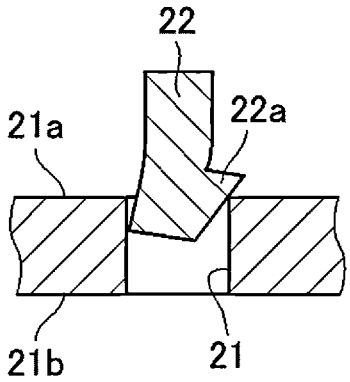
FIG. 11B is an explanatory view illustrating the example of the first engagement portion and the second engagement portion.
Figure 11C:
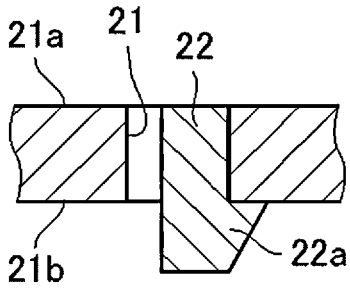
FIG. 11C is an explanatory view illustrating the example of the first engagement portion and the second engagement portion.

FIGS. 11A to 11C are explanatory views illustrating an example of the first engagement portion 21 and the second engagement portion 22.

First, from the state illustrated in FIG. 11A, the second engagement portion 22, which is a protruding portion provided on the top part 12 side, is inserted into the first engagement portion 21, which is a recessed portion provided on the main body part 11 side (strictly speaking, the connecting portion 15), from a front surface 21*a* side of the first engagement portion 21 so as to be pushed in a direction of an arrow in the drawing. At this time, as in the state illustrated in FIG. 11B, the second engagement portion 22 is bent, so that the second engagement portion 22 is smoothly inserted into the first engagement portion 21. When the second engagement portion 22 is inserted into the first engagement portion 21, as in the state illustrated in FIG. 11C, the bent second engagement portion 22 returns to its original shape, so that a stopper 22*a* is hooked and fastened to a back surface 21*b* side of the first engagement portion 21, and the first engagement portion 21 and the second engagement portion 22 are fixed.

Note that, while the first engagement portion 21 of the main body part 11 is the recessed portion and the second engagement portion 22 of the top part 12 is the protruding portion, the recessed portion and the protruding portion may be reversed.

Moreover, the engagement method is not limited to the above-described method, and an engagement method other than the above-described method may be employed.

Figure 12:
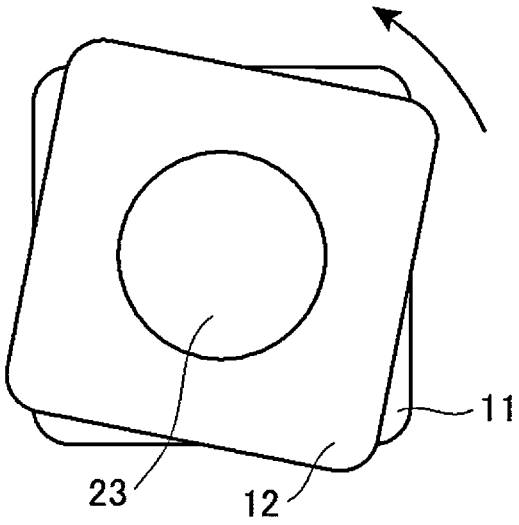
FIG. 12 is an explanatory view of another engagement method.
Figure 13A:
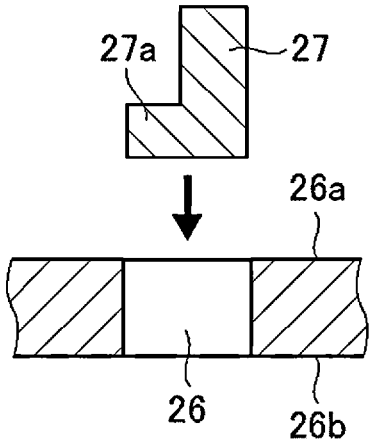
FIG. 13A is an explanatory view illustrating an example of a first engagement portion and a second engagement portion in the other engagement method.
Figure 13B:
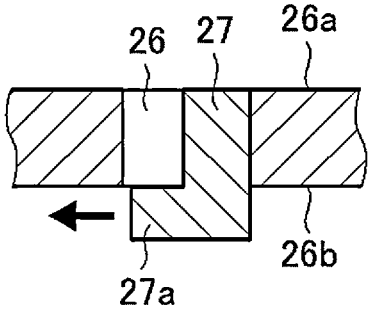
FIG. 13B is an explanatory view illustrating the example of the first engagement portion and the second engagement portion in the other engagement method.
Figure 13C:
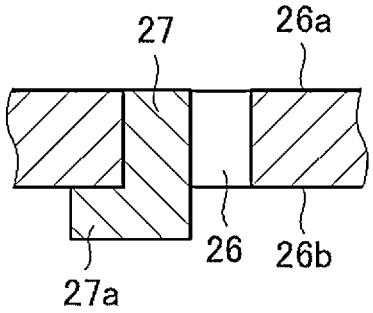
FIG. 13C is an explanatory view illustrating the example of the first engagement portion and the second engagement portion in the other engagement method.
Figure 14:
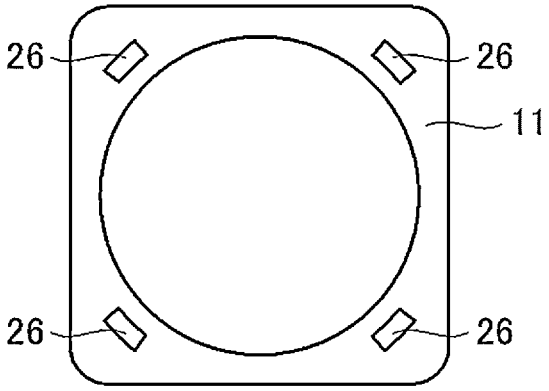
FIG. 14 is a plan view illustrating an example of a shape of the first engagement portion in the other engagement method.
Figure 15:
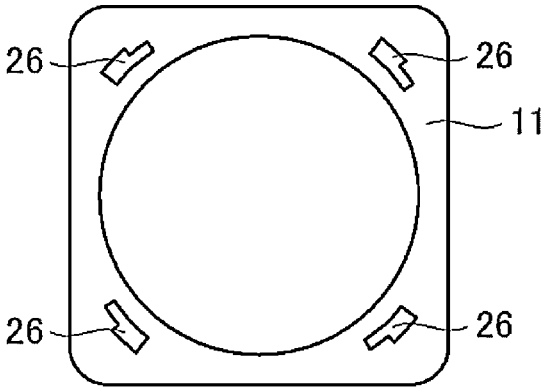
FIG. 15 is a plan view illustrating another example of the shape of the first engagement portion in the other engagement method.

FIG. 12 is an explanatory view of another engagement method. FIGS. 13A to 13C are explanatory views illustrating an example of a first engagement portion 26 and a second engagement portion 27 in the other engagement method. FIG. 14 is a plan view illustrating an example of a shape of the first engagement portion 26 in the other engagement method. FIG. 15 is a plan view illustrating another example of the shape of the first engagement portion 26 in the other engagement method.

For example, as illustrated in FIG. 12, the top part 12 may be attached to the main body part 11 by inserting the second engagement portion 27 into the first engagement portion 26 in a state in which the top part 12 is slightly shifted with respect to the main body part 11, and then rotating the top part 12 with respect to the main body part 11 so as to be twisted in a direction indicated by an arrow in the drawing. Specifically, in the state illustrated in FIG. 13A, the second engagement portion 27, which is a protruding portion provided on the top part 12 side, is inserted into the first engagement portion 26, which is a recessed portion provided on the main body part 11 side (strictly speaking, the connecting portion 15), from a front surface 26*a* side of the first engagement portion 26 in a direction of an arrow in the drawing while the direction of a stopper 27*a* formed at a distal end of the second engagement portion 27 meets the shape of the first engagement portion 26. Then, after the second engagement portion 27 is inserted into the first engagement portion 26, the top part 12 is rotated with respect to the main body part 11 so as to be twisted in the direction of the arrow in FIG. 12. Accordingly, as illustrated in FIG. 13B, the second engagement portion 27 moves in a direction indicated by an arrow in the drawing. Then, as in the state illustrated in FIG. 13C, the stopper 27*a* of the second engagement portion 27 is hooked and fastened to a back surface 26*b* side of the first engagement portion 26, and the first engagement portion 26 and the second engagement portion 27 are fixed.

Note that, the shape of the first engagement portion 26 may be any shape as long as the stopper 27*a* of the second engagement portion 27 can pass therethrough. For example, the shape may be a substantially quadrangular shape as illustrated in FIG. 14, or may be a shape partly having a wide portion as illustrated in FIG. 15.

The holder 10 of the present embodiment is configured as described above, and the top part 12 that is a part of the holder 10 can be fixed to the main body part 11 that is another part of the holder 10, and can be detached and separated from the main body part 11. Accordingly, the state of the holder 10 can be freely switched between the first state and the second state described above. In the first state, the internal space 16 is opened. In contrast, in the second state, the bottom part 13 supports the bottom surface of the bottle 30 in the internal space 16, the pillar part 14 including the grip portion 19 is positioned beside the body part 32 of the bottle 30, and the neck part 31 of the bottle 30 protrudes from the opening 23 of the top part 12.

By switching the state of the holder 10 between the first state and the second state as described above, when the bottle 30 is put into the holder 10, the state of the holder 10 is set to the first state and the bottle 30 can be put into the internal space 16. Also, when the bottle 30 is stored in the holder 10 or the bottle 30 in the state held by the holder 10 is carried, the state of the holder 10 is set to the second state. Further, when the bottle 30 is taken out of the holder 10 because the bottle 30 becomes empty or the like, if the state of the holder 10 is changed to the first state again, the bottle 30 can be taken out from the internal space 16.

Advantageous effects of the holder 10 of the present embodiment described above will be described below.

The holder 10 includes the grip portion 19 composed of the cutout portion 20, and the user grabs and grips the grip portion 19 when holding the holder 10. Accordingly, the holder 10 can be easily held, and the bottle 30 stored in the holder 10 can be easily carried. Note that, since the grip portion 19 of the holder 10 is easier to grab (grip) than the handle 33 of the bottle 30, it is easier to hold the holder 10 in which the bottle 30 is housed than a case where the bottle 30 alone is held, and for example, it is easier to lift the bottle 30 to a high position.

Moreover, the holder 10 holds the bottle 30 in a state in which the neck part 31 of the bottle 30 protrudes from the opening 23 while the body part 32 of the bottle 30 is restrained by the top part 12. Thus, the liquid or the like in the bottle 30 can be easily taken out (poured) from the bottle 30 by lifting and tilting the holder 10 in a state in which the bottle 30 is housed.

Moreover, the outer side surface 24 of the top part 12 is inclined with respect to the height direction of the holder 10 so as to be separated from the center of the top part 12 toward the lower side, that is, in the direction in which the outer side surface 24 is lowered from the opening 23 toward the outer edge 25 of the top part 12. Thus, for example, when the liquid or the like in the bottle 30 is taken out and poured into another container, the holder 10 does not interfere with the other container, and the liquid or the like in the bottle 30 can be taken out more easily.

Moreover, the holder 10 supports the bottom surface of the bottle 30 by the bottom part 13, and protects the body part 32 of the bottle 30 from above and from the side by the top part 12 and the grip portion 19. Accordingly, the bottle 30 can be safely stored in the internal space 16. Thus, when the bottle 30 is stored, carried, or transported, packaging materials other than the holder 10 can be omitted. Further, the bottle can be stocked (stored) more safely because the bottle can be prevented from toppling over and breaking.

Moreover, the plurality of pillar parts 14 including the grip portions 19 are disposed around the body part 32 of the bottle 30 in a state of being separated from each other. Thus, the body part 32 of the bottle 30 or a label or the like attached to the body part 32 can be visually recognized from the outside of the holder 10 in the state in which the bottle 30 is held by the holder 10.

Moreover, the holder 10 can switch the state of the holder 10 between the first state and the second state. When the state of the holder 10 is set to the first state, the internal space 16 of the holder 10 is opened, and the bottle 30 can be easily taken in and out. At this time, since the top part 12 is detachable from the main body part 11 by the engagement structure of the first engagement portion 21 and the second engagement portion 22, attachment and detachment of the top part 12 are facilitated. As a result, it is possible to easily switch between the first state and the second state.

Moreover, since the holder 10 connects the pillar parts 14 to each other at upper end portions of the pillar parts 14 by the connecting portions 15, it is possible to stably hold the shape of the pillar parts 14 (to be easily understood, it is possible to suppress the flexural deformation of the pillar parts 14). Also, in the present embodiment, since the connecting portion 15 extends linearly between the pillar parts 14, it is possible to avoid interference between the bottle 30 and the connecting portion 15 when the bottle 30 is put into the internal space 16. Accordingly, it is easier to put the bottle 30 into the internal space 16 in this embodiment.

As described above, the holder 10 of the present embodiment can properly hold the bottle 30 in a situation in which the bottle 30 is stored, carried, or transported, or a liquid or the like in the bottle 30 is taken out, and the holder 10 itself is easily handled.

Second Embodiment

In the holder 10 of the above-described first embodiment, the top part is detachable from the main body part, and the state of the holder is switched by attaching and detaching the top part; however, the present invention is not limited thereto. For example, the main body part and the top part may be integrated, and the integrated main body part and top part (that is, the holder) may be divided into a plurality of components to switch between the first state and the second state. The holder having such a configuration will be described in detail below as a second embodiment.

Figure 16:
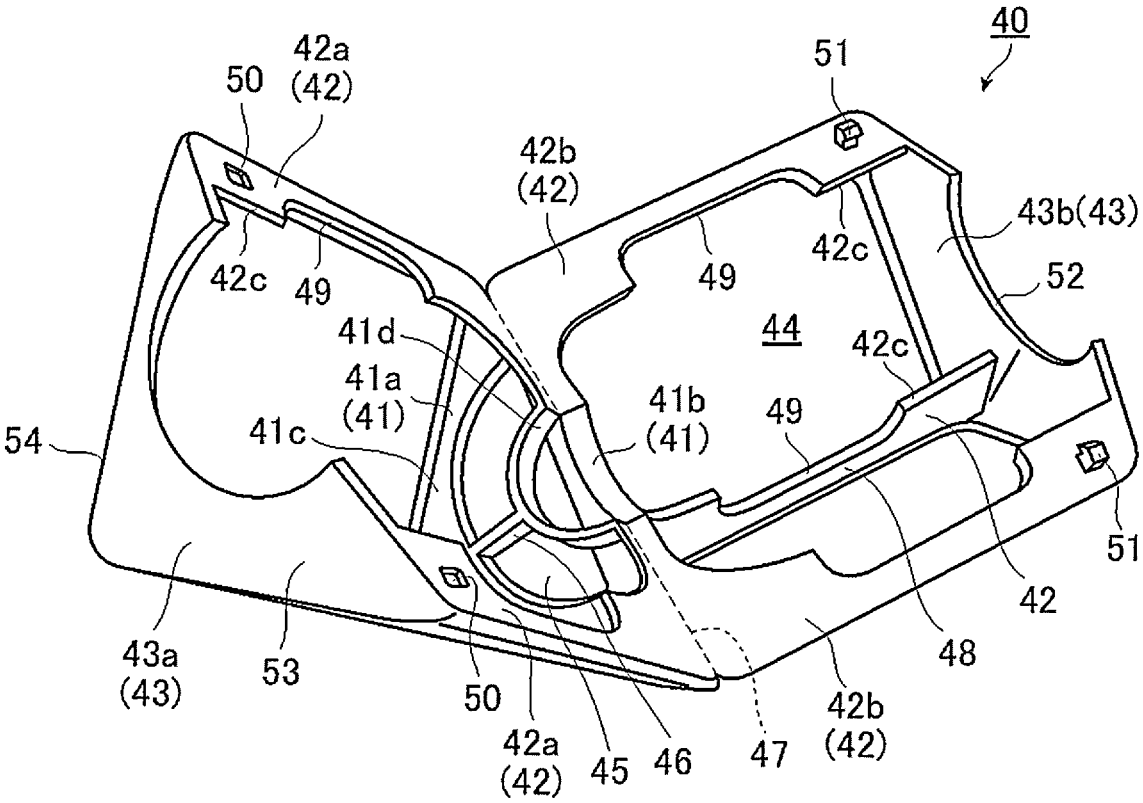
FIG. 16 is a perspective view illustrating a first state of a holder according to a second embodiment of the present invention.
Figure 17:
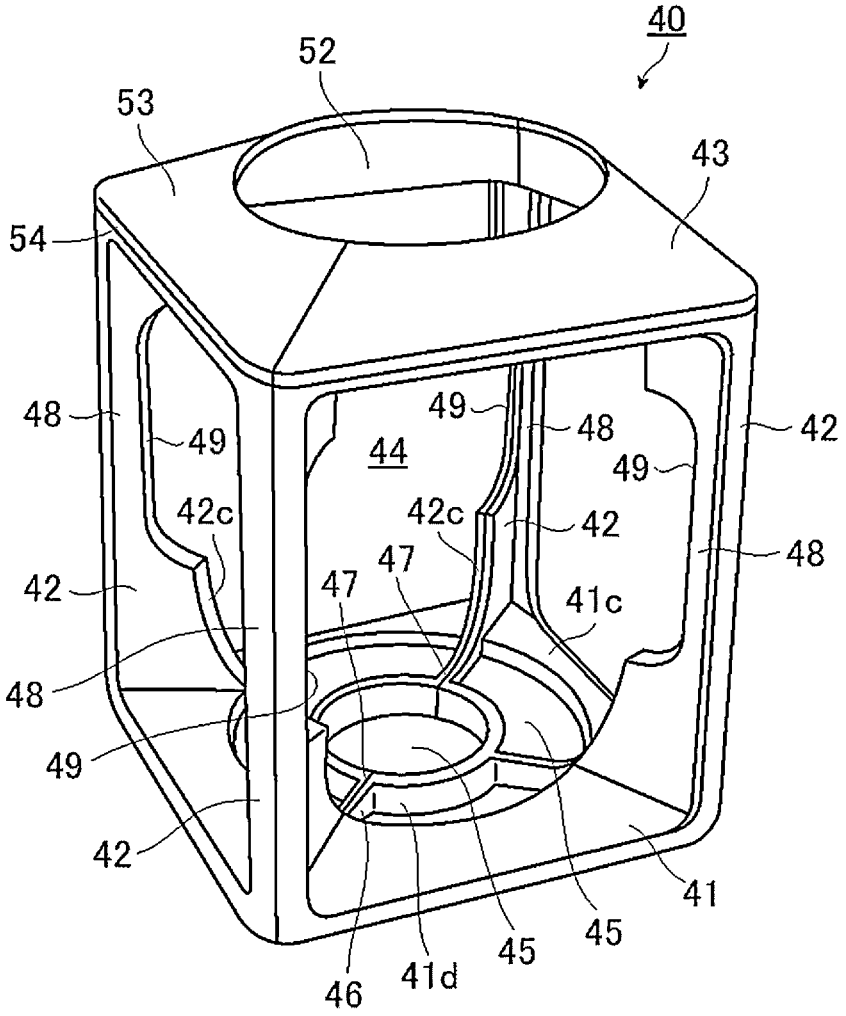
FIG. 17 is a perspective view illustrating a second state of the holder according to the second embodiment of the present invention.

FIG. 16 is a perspective view illustrating a first state of the holder (hereinafter referred to as a holder 40) according to the second embodiment of the present invention. FIG. 17 is a perspective view illustrating a second state of the holder 40.

As illustrated in FIGS. 16 and 17, the holder 40 has a bottom part 41, a pillar part 42, and a top part 43. The external appearance of the holder 40 is similar to that of the holder 10 according to the first embodiment. Also, when the state of the holder 40 is the second state, a region surrounded by the bottom part 41, the pillar part 42, and the top part 43 defines an internal space 44.

Note that, the shape, material and so forth of each part of the holder 40 are substantially similar to those of the holder 10 according to the above-described first embodiment.

As illustrated in FIGS. 16 and 17, the bottom part 41 has an outer portion 41*c* and an annular inner portion 41*d*. Holes 45 are provided between the outer portion 41*c* and the inner portion 41*d* and inside the inner portion 41*d* to communicate the internal space 44 with the outside of the holder 40. Also, ribs 46 extend radially from an outer peripheral surface of the inner portion 41*d*.

The bottom part 41 can be divided into two bottom part pieces 41*a* and 41*b* at a linear joint portion 47 provided substantially at the center position of the bottom part 41. Note that, the bottom part 41 may be completely divided into the respective bottom part pieces 41*a* and 41*b*; however, in the present embodiment, like a so-called living hinge, the thickness of the joint portion 47 is made thinner than those of the other portions so that the bottom part 41 can be bent. In the second embodiment, the state in which the bottom part 41 is opened with the joint portion 47 as a starting point and divided into the two bottom part pieces 41*a* and 41*b* is the first state. In contrast, a state in which the bottom part 41 is bent so as to be closed with the joint portion 47 as a starting point and the two bottom part pieces 41*a* and 41*b* are joined to each other is the second state.

Pillar parts 42 are erected at four corners of the bottom part 41, respectively, and extend in a height direction of the holder 40. Also, a grip portion 48 is provided at an intermediate position of each pillar part 42, and specifically, the grip portion 48 is composed of a cutout portion 49 formed by cutting out a portion of an inner end portion 42*c* of the pillar part 42.

Two pillar parts 42 facing each other on the joint portion 47 among the four pillar parts 42 each can be divided into two pillar part pieces 42*a* and 42*b*, as illustrated in FIG. 16. Also, as illustrated in FIG. 16, a third engagement portion 50, which is a recessed portion, is provided at a portion of one pillar part piece 42*a* that comes into contact with the other pillar part piece 42*b*. Correspondingly, a fourth engagement portion 51, which is a protruding portion that engages with the third engagement portion 50, is provided at a portion of the other pillar part piece 42*b* that comes into contact with the one pillar part piece 42*a*.

A state in which each of the two pillar parts 42 is divided into the two pillar part pieces 42*a* and 42*b* in conjunction with the division of the bottom part 41 by the engagement structure of the above-described recess and protrusion is the first state. In contrast, in each of the above-described two pillar parts 42, a state in which the pillar part pieces 42*a* and 42*b* are joined to each other and the third engagement portion 50 and the fourth engagement portion 51 engage with each other so that each of the two pillar parts 42 defines a pillar shape is the second state.

Note that, the engagement structure of the third engagement portion 50 and the fourth engagement portion 51 is substantially similar to the engagement structure of the first engagement portion 21 and the second engagement portion 22 in the above-described first embodiment.

The top part 43 is placed on upper ends of the pillar parts 42.

A circular hole-shaped opening 52 is provided at an upper end of the top part 43. Also, an outer side surface 53 of the top part 43 is inclined with respect to the height direction of the holder 40 so as to be separated from the center of the top part 43 toward a lower side, that is, in a direction in which the outer side surface 53 is lowered from the opening 52 toward an outer edge 54 of the top part 43.

The top part 43 can be divided into two top part pieces 43*a* and 43*b* at a position continuous with the dividing position of each of the two dividable pillar parts 42 (to be easily understood, a position directly above the joint portion 47). With such a configuration, a state in which the top part 43 is divided into the two top part pieces 43*a* and 43*b* in conjunction with the division of the bottom part 41 and the pillar parts 42 is the first state. In contrast, a state in which the top part pieces 43*a* and 43*b* are joined to each other to constitute the top part 43 is the second state.

In the second embodiment, the holder 40 configured as described above can be divided into a plurality of components, and is divided into two components in the example illustrated in FIGS. 16 and 17. However, the number of components when the holder 40 is divided is not limited to two, and may be three or more. Also, each of the plurality of components obtained by dividing the holder 40 has the bottom part piece 41*a* or 41*b* as a portion of the bottom part 41, the top part piece 43*a* or 43*b* as a portion of the top part 43, and the pillar part piece 42*a* or 42*b* as a portion of the pillar parts 42 including the grip portions 48.

The state of the holder 40 becomes the first state when one of the plurality of components is detached from another component, and becomes the second state when the one component is attached to the other component and the plurality of components are combined. With such a configuration, in addition to advantageous effects similar to the advantageous effects attained by the holder 10 of the first embodiment described above, an advantageous effect that the state of the holder 40 can be switched without detaching the top part 43 can also be attained.

Third Embodiment

It is desirable that the holder is in a three dimensional shape when holding the bottle; however, is developed so as not to be bulky at other times (at the time of non-use). Thus, a holder configured to be developable will be described in detail below as a third embodiment.

Figure 18:
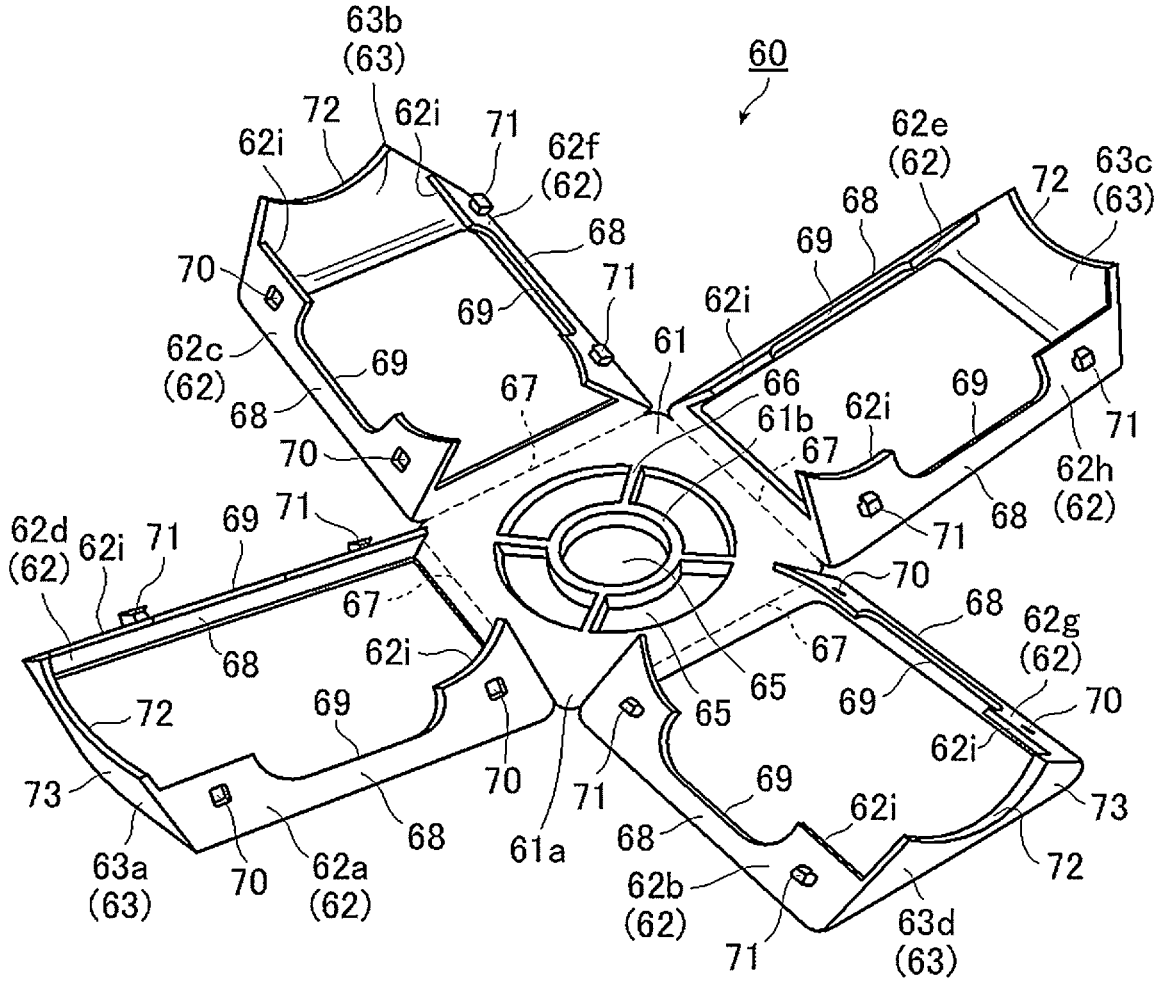
FIG. 18 is a perspective view illustrating a first state of a holder according to a third embodiment of the present invention.
Figure 19:
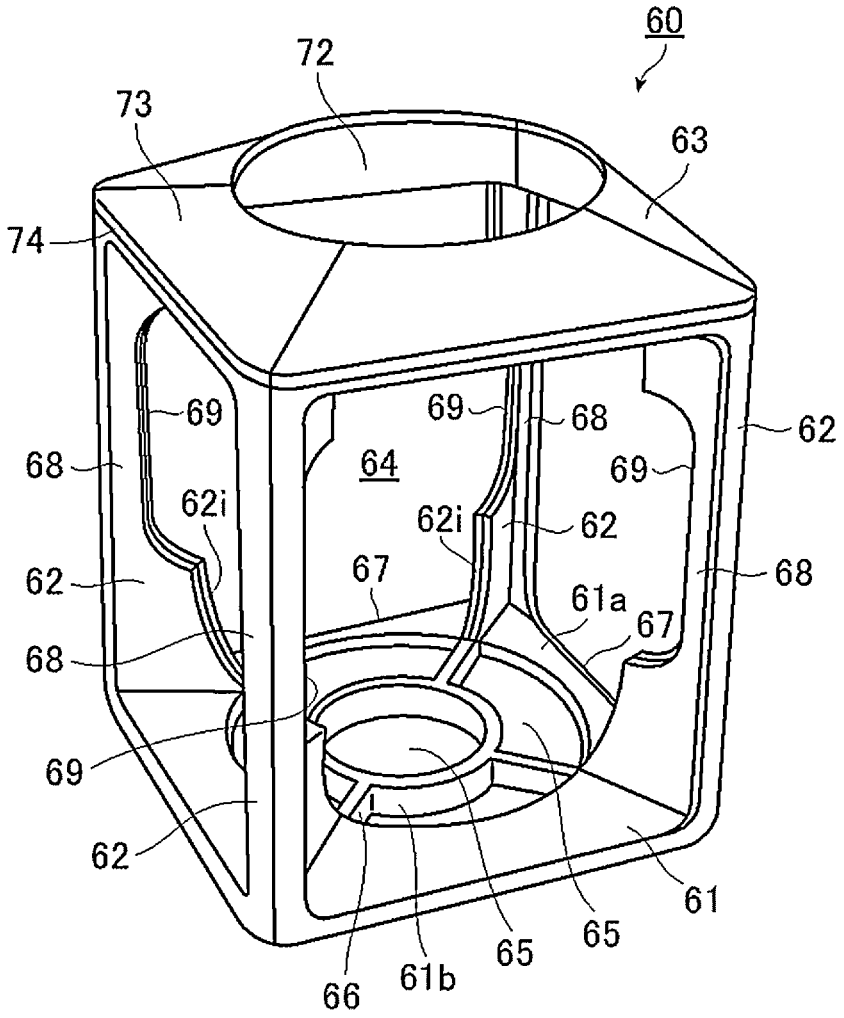
FIG. 19 is a perspective view illustrating a second state of the holder according to the third embodiment of the present invention.

FIG. 18 is a perspective view of a developed state of a holder (hereinafter referred to as a holder 60) according to the third embodiment. FIG. 19 is a perspective view illustrating a state at the time of assembling the holder 60.

As illustrated in FIGS. 18 and 19, the holder 60 has a bottom part 61, an extension part 62 defining a pillar part, and a top part 63. A grip portion 68 is provided at an intermediate position of the extension part 62 defining the pillar part.

At the time of use (that is, in a second state), the holder 60 is assembled three dimensionally as illustrated in FIG. 19, and a region surrounded by the bottom part 61, the extension part 62 defining the pillar part, and the top part 63 defines an internal space 64.

Note that, the shape, material, and so forth of each part of the holder 60 are substantially similar to those of the holder 10 according to the first embodiment and the holder 40 according to the second embodiment described above.

As illustrated in FIGS. 18 and 19, the bottom part 61 has an outer portion 61*a* and an annular inner portion 61*b*, and includes holes 65 between them and inside the inner portion 61*b*. Also, ribs 66 extend radially from an outer peripheral surface of the inner portion 61*b*.

Moreover, as illustrated in FIG. 18, a joint portion 67 for joining a lower end of the extension part 62 and the bottom part 61 is provided on each of four sides defining an outer edge of the bottom part 61 having a quadrangular shape. Like the joint portion 47 in the second embodiment, the joint portion 67 is composed of, for example, a so-called living hinge, and is configured to be bendable by making the thickness of the joint portion 67 thinner than those of the other portions. That is, the joint portion 67 functions as a bending starting point in development or assembling of the holder 60.

The extension part 62 is a member whose one end is rotatably joined to the outer edge of the bottom part 61 via the joint portion 67. When the holder 60 is used, the extension part 62 is erected with respect to the bottom part 61 and extended in a height direction of the holder 60 to become the pillar part. Also, the extension part 62 is positioned beside the body part 32 of the bottle 30 in a state in which the holder 60 holds the bottle 30 in the internal space 64 (that is, the second state).

As illustrated in FIG. 19, the extension part 62 serves as the pillar part when the holder 60 is used as described above, and a portion positioned at an intermediate position thereof functions as a grip portion 68. Specifically, the grip portion 68 is composed of a cutout portion 69 formed by cutting out a portion of an inner end portion 62*i* of the extension part 62.

As illustrated in FIG. 19, the holder 60 has four extension parts 62 in total respectively disposed on four sides defining an outer edge of the bottom part 61. Each of the extension parts 62 can be divided into corresponding two of extension part pieces 62*a* to 62*h*. Each of one extension part pieces 62*a*, 62*c*, 62*e*, and 62*g* of the two extension part pieces includes a fifth engagement portion 70, which is a recessed portion, at a portion that comes into contact with the counterpart extension part piece 62*b*, 62*d*, 62*f*, or 62*h*. In contrast, each of the extension part pieces 62*b*, 62*d*, 62*f*, and 62*h* includes a sixth engagement portion 71, which is a protruding portion that engages with the fifth engagement portion 70, at a portion that comes into contact with the counterpart extension part piece 62*a*, 62*c*, 62*e*, or 62*g*.

At the time of non-use, each extension part 62 falls down with the joint portion 67 as a starting point and is disposed at a position side by side with the bottom part 61. In this case, the extension parts 62 are divided into the extension part pieces 62*a* to 62*h*. As illustrated in FIG. 18, when this state is attained, the holder 60 is developed, and released and expanded from the three dimensional shape illustrated in FIG. 19.

In contrast, at the time of use, the extension part pieces 62*a* to 62*h* constituting the respective extension parts 62 are erected with respect to the bottom part 61 with the joint portion 67 as a starting point, the pairs of extension part pieces 62*a* to 62*h* are joined to each other, and the fifth engagement portions 70 and the sixth engagement portions 71 provided at the extension part pieces 62*a* to 62*h* engage with each other. Accordingly, each of the extension parts 62 functions as a pillar part.

Note that, the engagement structure of the fifth engagement portion 70 and the sixth engagement portion 71 is substantially similar to the engagement structure of the first engagement portion 21 and the second engagement portion 22 according to the above-described first embodiment.

The top part 63 is placed on upper ends of the extension parts 62.

A circular hole-shaped opening 72 is provided at an upper end of the top part 63. Also, an outer side surface 73 of the top part 63 is inclined with respect to the height direction of the holder 60 so as to be separated from the center of the top part 63 toward a lower side, that is, in a direction in which the outer side surface 73 is lowered from the opening 72 toward an outer edge 74 of the top part 63.

The top part 63 can be divided into four top part pieces 63*a* to 63*d* at a position continuous with the dividing positions of the extension parts 62. When the holder 60 is developed, the top part 63 is divided into the top part pieces 63*a* to 63*d* in conjunction with the division of the extension parts 62. In contrast, when the holder 60 is used, each of the top part pieces 63*a* to 63*d* is joined to corresponding ones of the top part pieces 63*a* to 63*d* (specifically, the top part piece 63*a* is joined to the top part pieces 63*b* and 63*d*, and the top part piece 63*c* is joined to the top part pieces 63*b* and 63*d*) to complete the top part 63.

As described above, the holder 60 of the third embodiment is configured to be developable, and the state of the holder 60 becomes the first state in which the internal space 64 is opened at the time of development (that is, at the time of non-use). In contrast, at the time of assembling (that is, at the time of use), the state of the holder 60 becomes the second state. With the holder 60 configured as described above, the state of the holder 60 can be switched without detaching the top part 63, in addition to advantageous effects similar to those of the holder 10 of the first embodiment described above.

Also, when the above-described holder 60 is injection-molded in the shape of the holder 60 in a developed state, the mold can be removed in one direction after the molding, so that the molding work is facilitated.

Further, when the holder 60 is developed at the time of non-use, the holder 60 in the developed state can be flatly stacked and stored.

Fourth Embodiment

In the holders of the first to third embodiments described above, a hole is provided in the bottom part. In this configuration, a member may be provided to receive liquid dripping at the above-described position of the hole in a case where the liquid in the bottle drips on the bottom part. A holder having such a configuration will be described in detail below as a fourth embodiment.

Note that, the holder according to the fourth embodiment may have the same structure as the holder according to any one of the first embodiment, the second embodiment, and the third embodiment except that the holder according to the fourth embodiment includes a liquid absorbing portion described below. Hereinafter, a structure in which the liquid absorbing portion is provided in the holder of the first embodiment will be described as an example.

Figure 20:
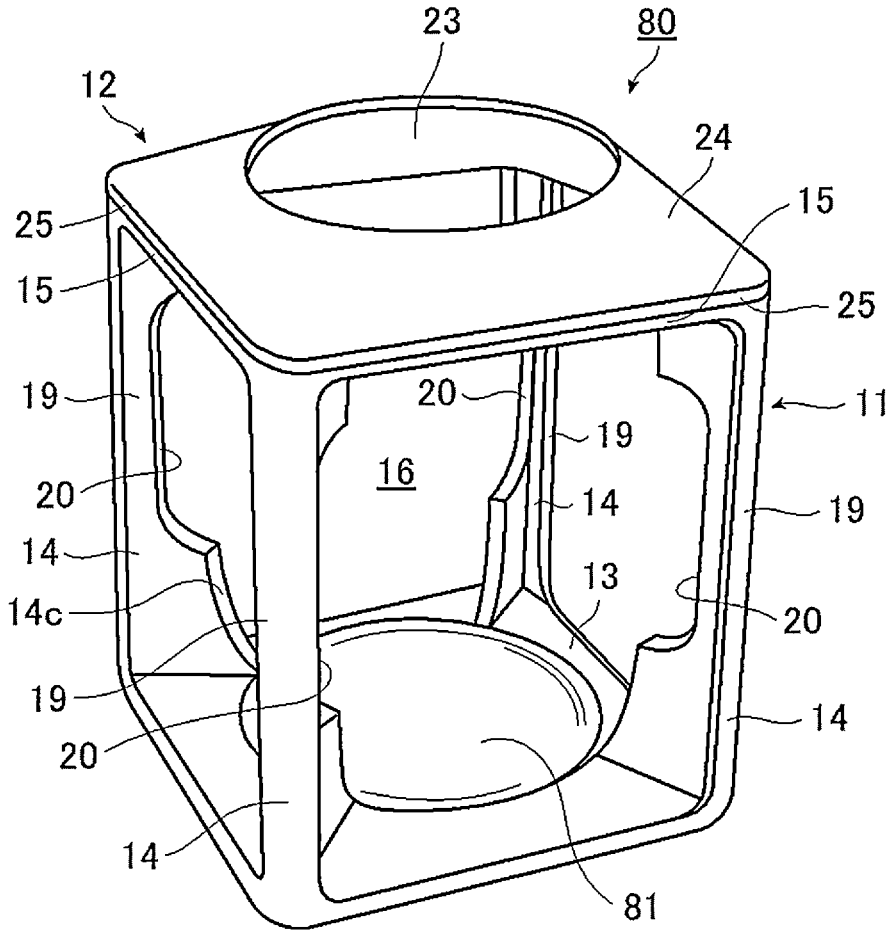
FIG. 20 is a perspective view illustrating a second state of a holder according to a fourth embodiment of the present invention.

FIG. 20 is a perspective view illustrating a second state of the holder (hereinafter referred to as a holder 80) according to the fourth embodiment.

As illustrated in FIG. 20, the holder 80 has a main body part 11 and a top part 12 that is detachably fixed to an upper portion of the main body part 11. The main body part 11 has a bottom part 13, a pillar part 14, and a connecting portion 15, and a region surrounded by the bottom part 13, the pillar part 14, and the connecting portion 15 defines an internal space 16.

In the fourth embodiment, a liquid absorbing portion 81 is detachably attached to the bottom part 13.

Note that, parts of the holder 80 other than the liquid absorbing portion 81 are similar to those in the first embodiment, and therefore, description thereof will be omitted.

The liquid absorbing portion 81 is a member detachably attached to, for example, an upper surface or a lower surface of the bottom part 13. FIG. 20 illustrates a case where the liquid absorbing portion 81 is provided on the upper surface of the bottom part 13.

The liquid absorbing portion 81 is an absorbent provided for retaining liquid on the bottom part 13 so as to prevent the liquid from diffusing to the outside of the holder 80, for example, when the liquid in the bottle 30 drips from the opening portion 34 of the bottle 30 along each part of the holder 10. The liquid absorbing portion 81 is composed of a material capable of absorbing and retaining liquid therein. For example, a water-absorbing polymer material such as SAP (Superabsorbent polymer), a porous member such as a sponge, a cloth or a fiber body having liquid absorbency such as an oil mat, or the like can be cited as a suitable material of the liquid absorbing portion 81.

In the fourth embodiment, for example, even if the liquid drips from the opening portion 34 when the holder 80 is placed at the original position after the holder 80 is lifted and the liquid in the bottle 30 is poured into another container, the liquid is absorbed by the liquid absorbing portion 81. Thus, it is possible to avoid a situation in which the dripping liquid contaminates the periphery of the holder 80.

Note that, instead of the liquid absorbing portion 81, a receiving pan or tray for receiving the liquid may be disposed on the lower surface of the bottom part 13 (strictly speaking, below the hole 17).

Fifth Embodiment

As a modification of the holder 10 of the first embodiment described above, for example, the shapes of the bottom part 13 and the connecting portion 15 may be changed. A holder having such a configuration will be described in detail below as a fifth embodiment.

Note that, in the following description, in the holder of the fifth embodiment (hereinafter, referred to as a holder 110), parts similar to those of the holder 10 of the first embodiment will not be described, and parts different from those of the holder 10 of the first embodiment will be mainly described.

Figure 21:
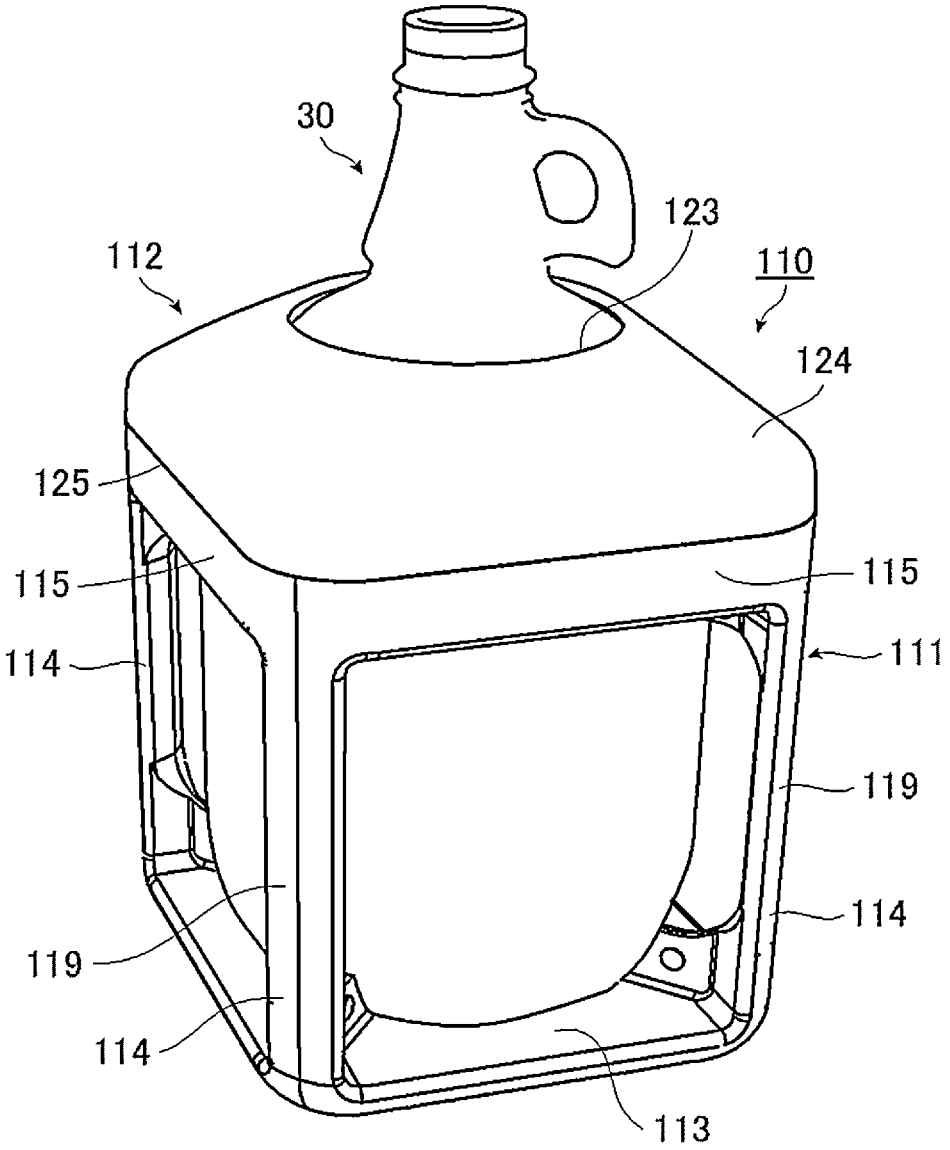
FIG. 21 is a perspective view illustrating a state in which a holder according to a fifth embodiment of the present invention is attached to a bottle and used.
Figure 22:
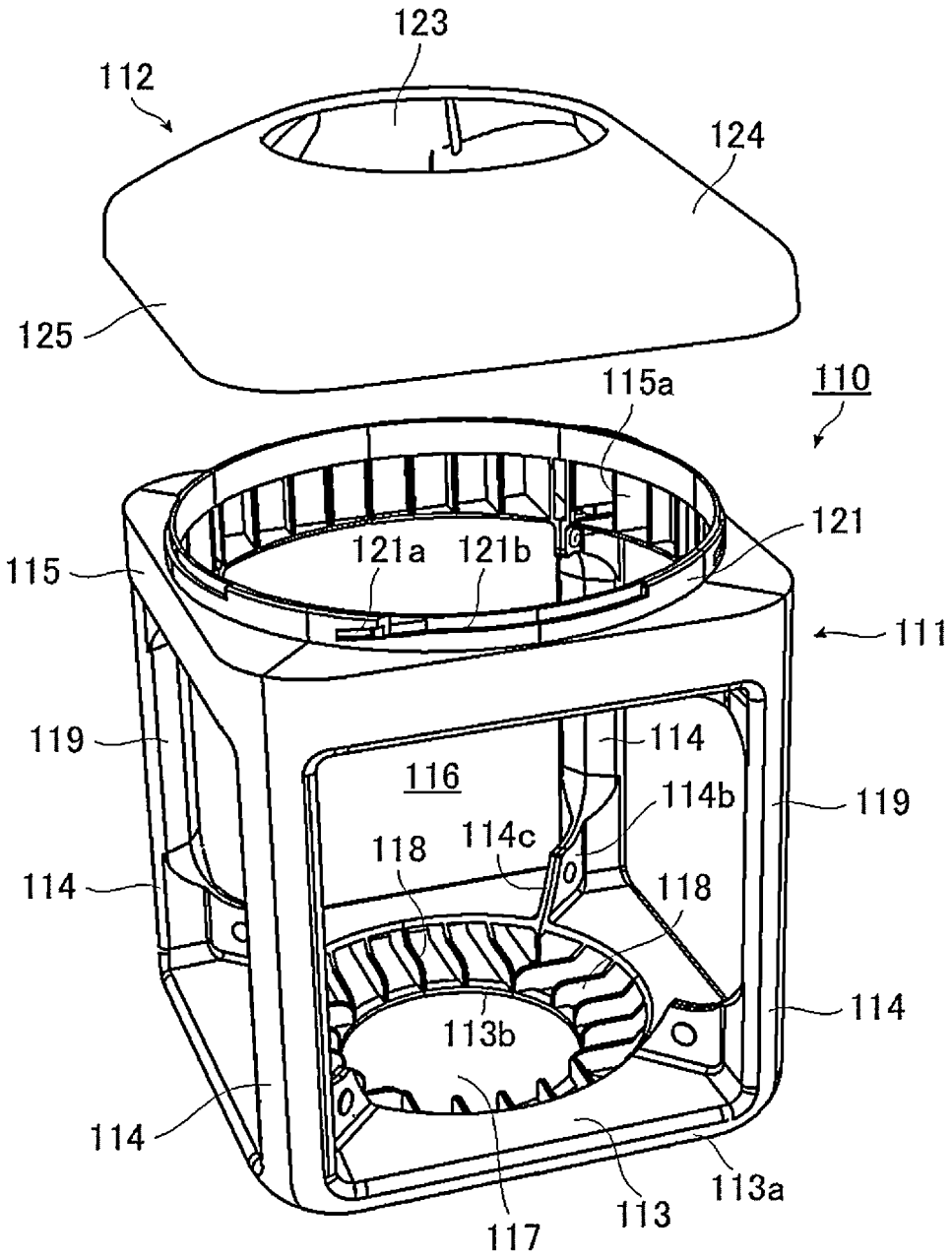
FIG. 22 is a perspective view illustrating a first state of the holder according to the fifth embodiment of the present invention when viewed from above.
Figure 23:
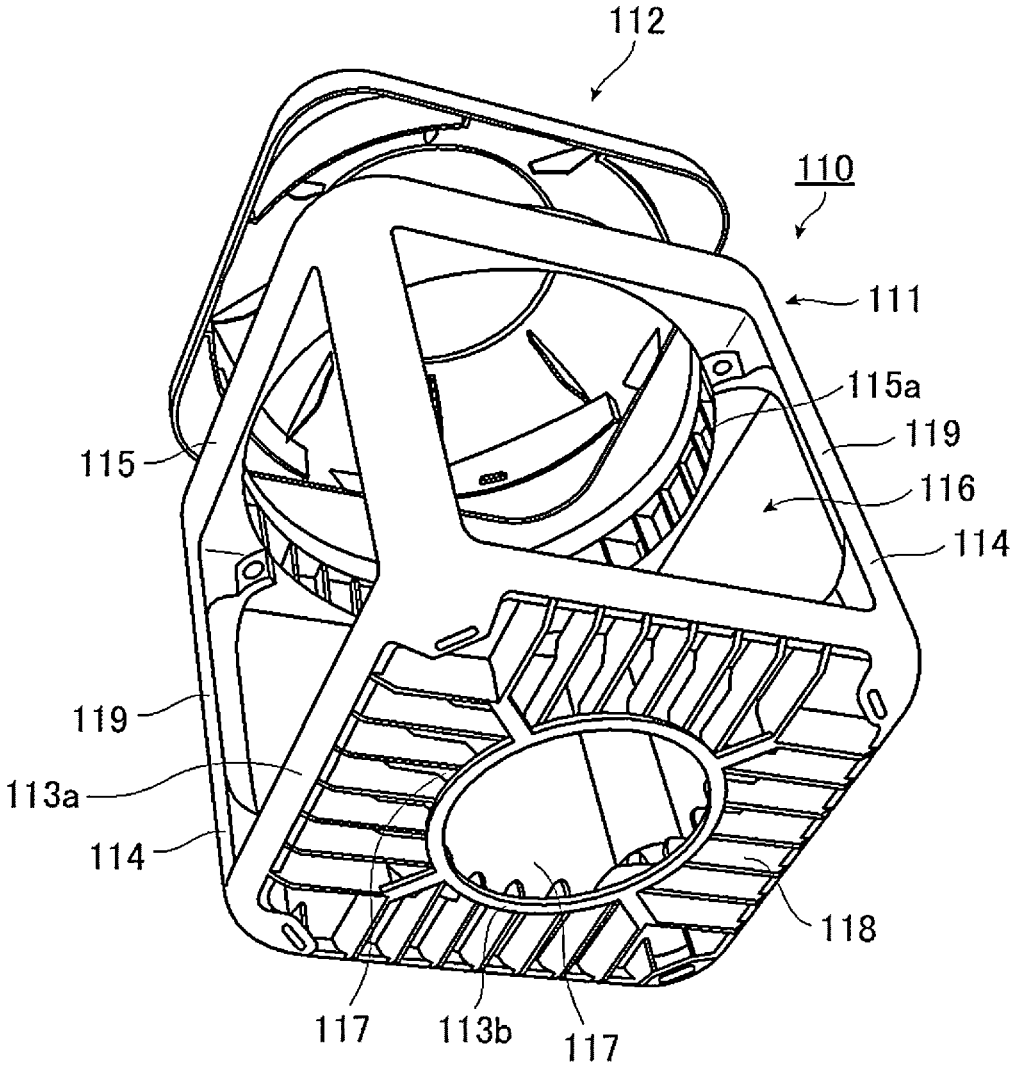
FIG. 23 is a perspective view illustrating the first state of the holder according to the fifth embodiment of the present invention when viewed from below.
Figure 24:
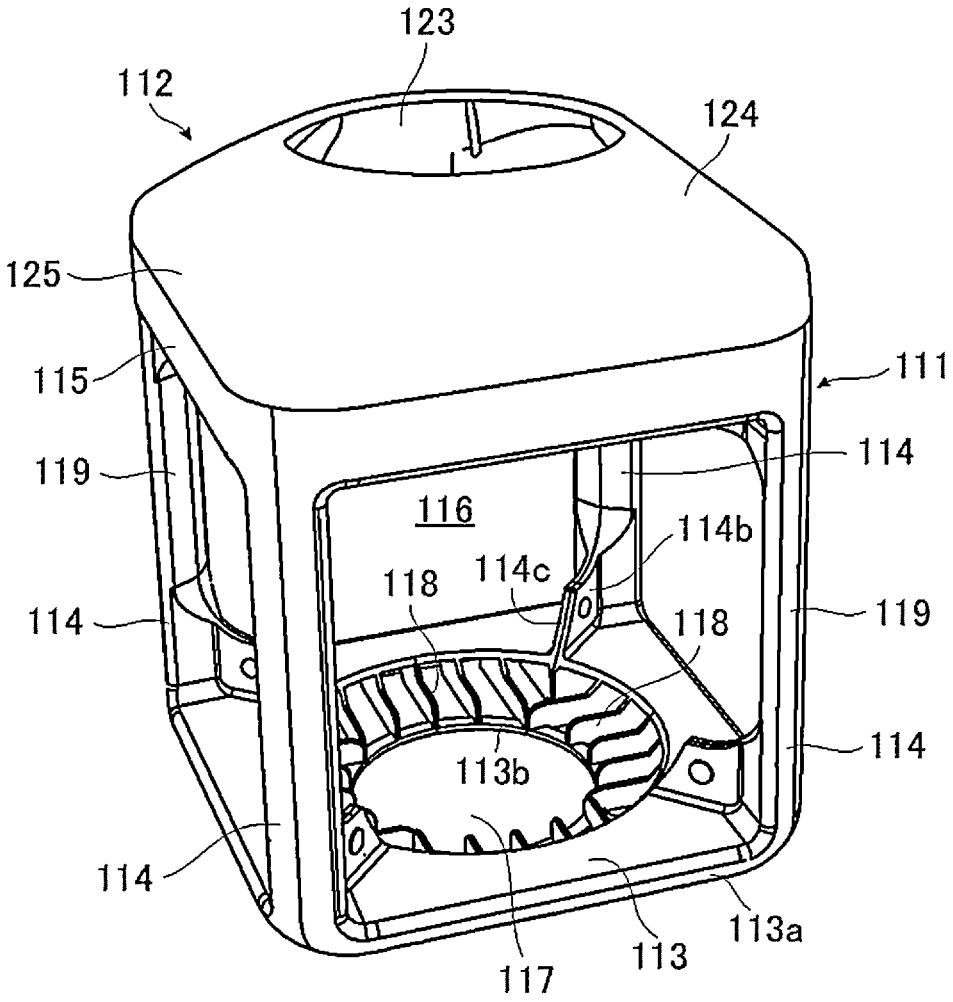
FIG. 24 is a perspective view illustrating a second state of the holder according to the fifth embodiment of the present invention.
Figure 25:
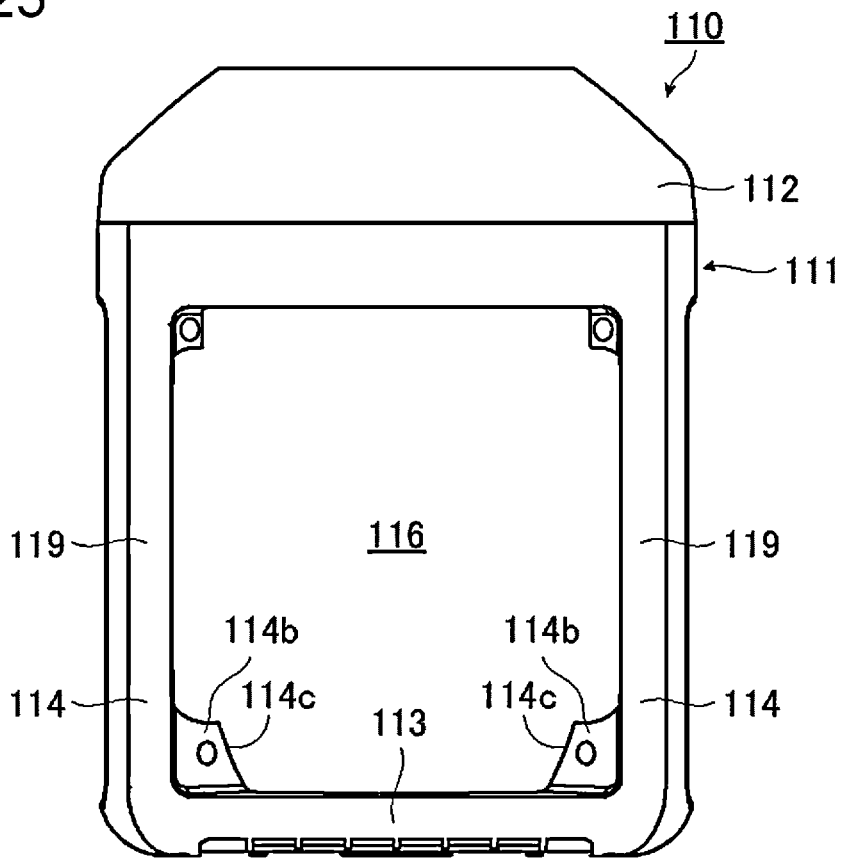
FIG. 25 is a front view illustrating the second state of the holder according to the fifth embodiment of the present invention.
Figure 26:
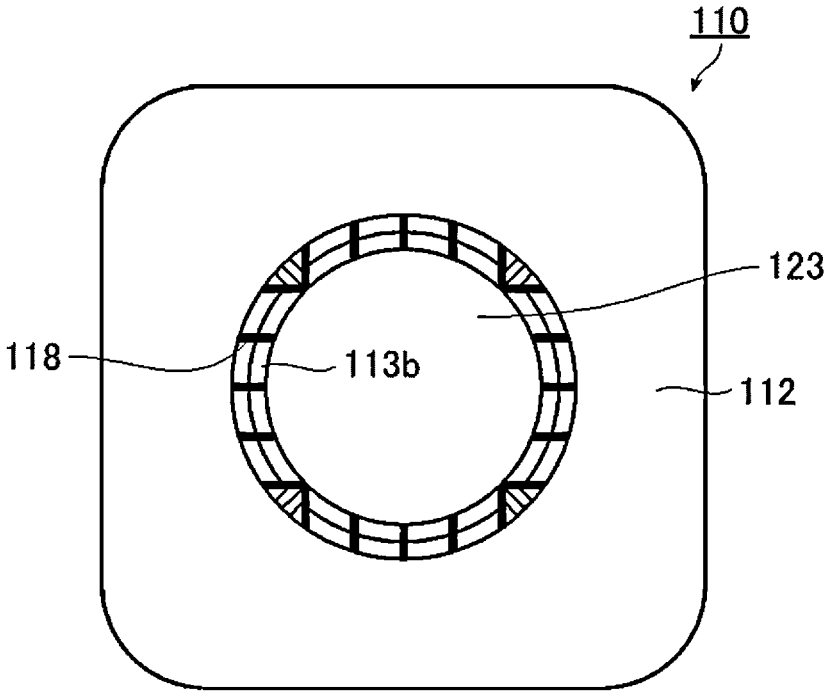
FIG. 26 is a plan view illustrating the second state of the holder according to the fifth embodiment of the present invention.
Figure 27:
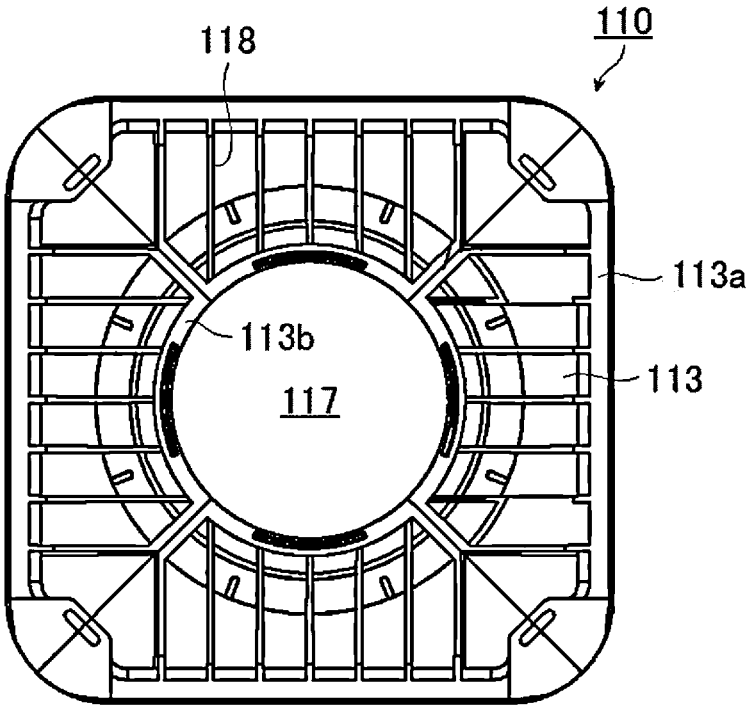
FIG. 27 is a bottom view illustrating the second state of the holder according to the fifth embodiment of the present invention.
Figure 28:
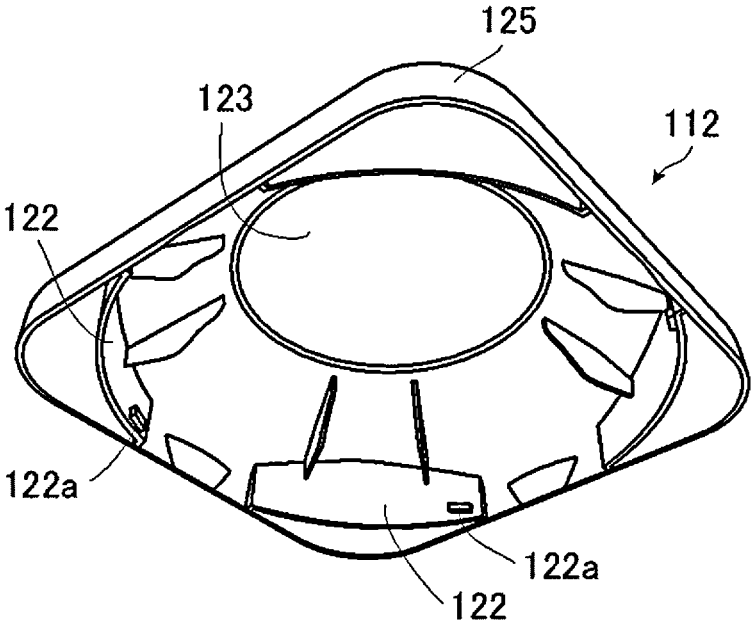
FIG. 28 is a perspective view of a top part according to the fifth embodiment of the present invention.

FIG. 21 is a perspective view illustrating a state in which the holder 110 is attached to the bottle 30 and used. FIG. 22 is a perspective view illustrating a first state of the holder 110 when viewed from above. FIG. 23 is a perspective view illustrating the first state of the holder 110 when viewed from below. FIG. 24 is a perspective view illustrating a second state of the holder 110. FIG. 25 is a front view illustrating the second state of the holder 110. FIG. 26 is a plan view illustrating the second state of the holder 110. FIG. 27 is a bottom view illustrating the second state of the holder 110. FIG. 28 is a perspective view of a top part 112.

Note that, a rear view, a right side view, and a left side view illustrating the second state of the holder 110 appear the same as the front view of FIG. 24.

As illustrated in FIGS. 21 to 27, a bottom part 113 has a square outer portion 113*a* whose central portion is punched out to define a circular hole having a relatively large diameter, and an annular inner portion 113*b* disposed at a portion where the outer portion 113*a* is punched out. Holes 117 are provided between the outer portion 113*a* and the inner portion 113*b* and inside the inner portion 113*b* to communicate an internal space 116 with the outside of the holder 110. Also, a plurality of ribs 118 extending from an outer peripheral surface of the inner portion 113*b* to an inner peripheral surface of the outer portion 113*a* are provided at a constant pitch.

As illustrated in FIGS. 21 to 25, a connecting portion 115 connects upper end portions of two adjacent pillar parts 114 among pillar parts 114 disposed at four corners of the bottom part 113, and is disposed in a frame shape so as to surround the internal space 116. A plurality of ribs 115*a* are provided at a constant pitch (at the same intervals as the ribs 118 of the bottom part 113) on the inner side (internal space 116 side) of the connecting portion 115. Also, a rising portion 121 having a first engagement portion 121*a* consisting of a recessed portion formed for attaching the top part 112 and a guide portion 121*b* consisting of a recessed portion connected to the first engagement portion 121*a* is provided at a portion of an upper surface of the connecting portion 115 that comes into contact with the top part 112. The recessed portion that is the first engagement portion 121*a* has a shape that engages with a second engagement portion 122*a* provided on the top part 112 side.

In contrast, as illustrated in FIG. 28, a rib 122 having a shape along the rising portion 121 and provided with the second engagement portion 122*a*, which is a protruding portion for attaching the top part 112 to a main body part 111, is provided at a portion of a back surface of the top part 112 that comes into contact with an upper end of the main body part 111. The second engagement portion 122*a* has a shape that engages with the first engagement portion 121*a* provided at the main body part 111, and is disposed at a position corresponding to the first engagement portion 121*a*. The second engagement portion 122*a* is provided at each of four positions in total.

Here, an engagement method by the first engagement portions 121*a* and the second engagement portions 122*a* will be described.

For example, similarly to the first embodiment described above, as illustrated in FIG. 12, in a state in which the top part 112 is slightly shifted with respect to the main body part 111, each of the second engagement portions 122*a* at the four positions is inserted into the guide portion 121*b* connected to the corresponding first engagement portion 121*a*. Then, the top part 112 is rotated so as to be twisted in the direction of the arrow in FIG. 12 with respect to the main body part 111 while being pushed toward the main body part 111 side. Accordingly, after the second engagement portion 122*a* is moved from the guide portion 121*b* to the first engagement portion 121*a*, the second engagement portion 122*a* becomes a state hooked and fastened to the first engagement portion 121*a* and is fixed to the first engagement portion 26.

Also in the holder 110 of the fifth embodiment, similarly to the holder 10 of the first embodiment, the top part 112 that is a part of the holder 110 can be fixed to the main body part 111 that is another part of the holder 110, and can be detached and separated from the main body part 111. Accordingly, the state of the holder 110 can be freely switched between the first state and the second state described above. In particular, in the holder 110, since the strength of the holder itself is increased by appropriately providing the ribs 118 and 115*a* on the bottom part 113 and the connecting portion 115, respectively, the bottle 30 can be held more safely.

Other Embodiments

Although five examples have been described above as specific embodiments of the present invention, the present invention is not limited to the above-described embodiments.

For example, in the above-described embodiment (specifically, the first embodiment), the bottom part 13, the pillar part 14 including the grip portion 19, and the connecting portion 15 constitute the main body part 11. However, the present invention is not limited thereto, and a configuration in which the pillar part 14, the connecting portion 15, and the top part 12 are integrated to form a main body part and the bottom part 13 is detachably attached to the main body part may be employed. At this time, for example, the main body part and the bottom part 13 may be fixed by inserting a lower end of the pillar part 14 into a groove or a hole provided in the bottom part 13.

Moreover, in the above-described embodiments (for example, the first embodiment), the top part 12 is attached to the main body part 11 by engaging the engagement portion provided at the upper end of the connecting portion 15 of the main body part 11 with the engagement portion provided at the top part 12. However, the present invention is not limited thereto. For example, in a configuration in which the connecting portion 15 is not provided, an engagement portion that engages with the top part 12 may be provided at an upper end of the pillar part 14, and the top part 12 may be attached to the main body part 11 using the engagement portion.

Moreover, in the above-described embodiments (for example, the first embodiment), the first engagement portion 21 is provided in the portion positioned directly above the pillar part 14 in the connecting portion 15; however, the present invention is not limited thereto. In the connecting portion 15, the first engagement portion 21 may be provided at a position avoiding a position directly above the pillar part 14, for example, at an intermediate position of the connecting portion 15.

Moreover, in the above-described embodiments, the outer side surfaces 24, 53, and 73 of the top parts 12, 43, and 63 each are provided with a smooth inclination, and the outer side surfaces 24, 53, and 73 each are lowered from the opening 23, 52, or 72 toward the outer edge 25, 54, or 74 of the top part. However, the present invention is not limited thereto, and for example, a configuration may be employed in which a step is provided in the outer side surface 24, 53, or 73, and the position of the outer side surface 24, 53, or 73 is lower on the outer edge 25, 54, or 74 side than on the opening 23, 52, or 72 side.

Moreover, in the above-described embodiments, the state of the holders 10, 40, 60, and 80 can be switched between the first state and the second state. Here, the holders 10, 40, 60, and 80 each may already be in a state of holding the bottle (that is, the second state) at the stage of shipment, and switching from the second state to the first state may be restricted on the user side. For example, when the state of the holder 10, 40, 60, or 80 is switched from the second state to the first state, a dedicated tool, a specialized technique, or the like may be required.

REFERENCE SIGNS LIST

10 holder
11 main body part
12 top part
13 bottom part
13*a* outer portion
13*b* first inner portion
13*c* second inner portion
14 pillar part
14*a* corner portion
14*b* rib-shaped portion
14*c* inner end portion
15 connecting portion
16 internal space
17 hole
18 rib
19 grip portion
20 cutout portion
21 first engagement portion
21*a* front surface
21*b* back surface
22 second engagement portion
22*a* stopper
23 opening
24 outer side surface
25 outer edge
26 first engagement portion
26*a* front surface
26*b* back surface
27 second engagement portion
27*a* stopper
30 bottle
31 neck part
32 body part
33 handle
34 opening portion
35 shoulder part
40 holder
41 bottom part
41*a*, 41*b* bottom part piece
41*c* outer portion
41*d* inner portion
42 pillar part
42*a*, 42*b* pillar part piece

42*c* inner end portion
43 top part
43*a*, 43*b* top part piece
44 internal space
45 hole
46 rib
47 joint portion
48 grip portion
49 cutout portion
50 third engagement portion
51 fourth engagement portion
52 opening
53 outer side surface
54 outer edge
60 holder
61 bottom part
61*a* outer portion
61*b* inner portion
62 extension part
62*a* to 62*h* extension part piece
62*i* inner end portion
63 top part
63*a* to 63*d* top part piece
64 internal space
65 hole
66 rib
67 joint portion
68 grip portion
69 cutout portion
70 fifth engagement portion
71 sixth engagement portion
72 opening
73 outer side surface
74 outer edge
80 holder
81 liquid absorbing portion
110 holder
111 main body part
112 top part
113 bottom part
113*a* outer portion
113*b* inner portion
114 pillar part
114*b* rib-shaped portion
114*c* inner end portion
115 connecting portion
116 internal space
117 hole
118 rib
119 grip portion
121 rising portion
121*a* first engagement portion
121*b* guide portion
122 rib
122*a* second engagement portion
123 opening
124 outer side surface
125 outer edge

What is claimed is:

1. A holder for holding, in an internal space, a bottle having a body part larger than a neck part below the neck part, the holder comprising:

a bottom part;

a top part having an opening smaller than a sectional size of the body part; and a grip portion extending in a height direction of the holder between the bottom part and the top part, wherein a state of the holder is switched between a first state and a second state, wherein, in the first state, a portion of the holder is detached and separated from another portion of the holder, and hence the internal space is opened, and wherein, in the second state, the bottom part supports a bottom surface of the bottle in the internal holding space, the grip portion is positioned beside the bottle, and the neck part protrudes from the opening, wherein a pillar part is erected on the bottom part, and the grip portion is provided at the pillar part, wherein a second pillar part is erected on the bottom part and disposed at a position separated from the pillar part, wherein a second grip portion is provided at the second pillar part, wherein the grip portion has a cutout portion formed by cutting out a portion of the pillar part that faces the internal holding space, wherein the cutout portion forms a part of the internal holding space, wherein the second grip portion has a second cutout portion formed by cutting out a portion of the second pillar part that faces the internal holding space, wherein the second cutout portion forms a part of the internal holding space, wherein the holder further has a connecting portion that the pillar part and the second pillar part at a position different from the bottom part, wherein the top part is detachable from a main body part having the bottom part and the grip portion, wherein the main body part has a first engagement portion, and wherein the top part has a second engagement portion that engages with the first engagement portion, wherein one of the first engagement portion and the second engagement portion is a recessed portion, and the other is a protruding portion, wherein the first engagement portion and the second engagement portion engage with each other by rotating the top part with respect connects to the main body part in a state in which the protruding portion is inserted into the recessed portion.

2. The holder according to claim 1, wherein an outer side surface of the top part is inclined with respect to the height direction so as to be separated from a center of the top part toward a lower side.

3. The holder according to claim 1, wherein the bottom part has a liquid absorbing portion.

* * * * *